US007766461B2

(12) United States Patent
Fukugawa et al.

(10) Patent No.: US 7,766,461 B2
(45) Date of Patent: Aug. 3, 2010

(54) LIQUID DROPLET EJECTING HEAD, IMAGE FORMING DEVICE, AND METHOD OF MANUFACTURING LIQUID DROPLET EJECTING HEAD

(75) Inventors: Atsushi Fukugawa, Kanagawa (JP); Hiroyuki Usami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 402 days.

(21) Appl. No.: 11/807,500

(22) Filed: May 29, 2007

(65) Prior Publication Data

US 2008/0151008 A1 Jun. 26, 2008

(30) Foreign Application Priority Data

Dec. 20, 2006 (JP) ..... 2006-342339

(51) Int. Cl.
*B41J 2/045* (2006.01)

(52) U.S. Cl. ..... 347/68

(58) Field of Classification Search ..... 347/68, 347/69–72; 400/124.17, 124.16; 310/363–366; 29/25.35

See application file for complete search history.

(56) References Cited

U.S. PATENT DOCUMENTS

2008/0012911 A1* 1/2008 Takabe et al. ..... 347/70

2008/0074473 A1* 3/2008 Takabe et al. ..... 347/70

FOREIGN PATENT DOCUMENTS

JP 7-148921 6/1995

* cited by examiner

*Primary Examiner*—K. Feggins
(74) *Attorney, Agent, or Firm*—Fildes & Outland, P.C.

(57) ABSTRACT

The present invention provides a liquid droplet ejecting head including: a pressure chamber connected to a nozzle ejecting liquid-droplets; a vibrating-plate forming one portion of the pressure chamber; a lower-electrode formed on a surface of the vibrating-plate, and exhibiting one polarity; a piezoelectric body of flexurally-deformable, formed on a surface of the lower electrode, and disposed at a position facing the pressure chamber with the vibrating-plate therebetween; and an upper-electrode formed at a surface of the piezoelectric body opposite the surface at which the lower-electrode is formed, the upper-electrode exhibiting another polarity, when viewed from a direction perpendicular to the surface of the lower-electrode, the piezoelectric body being provided further toward an inner side than a peripheral wall of the pressure chamber, and the lower-electrode being of a size such that one portion thereof overlaps with the peripheral wall of the pressure chamber, and being individuated per each piezoelectric body.

16 Claims, 24 Drawing Sheets

72

72
72A
72A
72A 72
72B
72A
72B
72A
72B
72A 72
72B
72A
76
72B
72A
76
72B
72A
76
UP
LO

UP ↔ LO

"overlap"
A
46
52
86
50
87
80
54
45
48A(48)
48A
72
48

LIQUID DROPLET EJECTING HEAD, IMAGE FORMING DEVICE, AND METHOD OF MANUFACTURING LIQUID DROPLET EJECTING HEAD

CROSS-REFERENCE TO RELATED APPLICATION

This application is based on and claims priority under 35 USC 119 from Japanese Patent Application No. 2006-342339 filed Dec. 20, 2006.

BACKGROUND

1. Technical Field

The present invention relates to a liquid droplet ejecting head, an image forming device, and a method of manufacturing a liquid droplet ejecting head.

2. Related Art

There have conventionally been known inkjet recording devices which selectively eject ink droplets from plural nozzles of an inkjet recording head (hereinafter, simply called "recording head" upon occasion) serving as a liquid droplet ejecting head which moves reciprocally in a main scanning direction, and print characters, images and the like onto a recording medium such as a recording sheet or the like which is conveyed-in along a sub scanning direction.

In developing low-cost, piezo-type (piezoelectric element) recording heads of high resolutions of 1200 dpi and, further, 2400 dpi as next-generation recording heads, in order to address the demand for improvements in the printing quality, the printing speed, and the like of the printer, research aiming for decreased size and higher density, operation at a lower voltage, and higher-speed response of the piezoelectric elements has progressed.

Among these, in the case of the structure of a piezoelectric element which is formed by patterning a lower electrode, it is important to make the thickness of the substrate, which becomes the vibrating plate on which a piezoelectric body is formed, thin in order to improve the displacement efficiency. However, if the substrate overall is made to be thin, there is the contradictory relationship that the rigidity of the substrate decreases and the stability of displacement worsens.

Further, by making the piezoelectric elements high density, the influence with respect to the piezoelectric elements by the rigidity of the substrate increase, accordingly, the dispersion in displacement efficiency among the respective piezoelectric elements becomes large when the rigidity of the substrate decreases.

SUMMARY

An aspect of the present invention is a liquid droplet ejecting head including: a nozzle that ejects a liquid droplet; a pressure chamber that is connected to the nozzle; a vibrating plate that forms one portion of the pressure chamber; a lower electrode that is formed on a surface of the vibrating plate, and exhibits one polarity; a piezoelectric body that is flexurally-deformable, formed on a surface of the lower electrode, and disposed at a position facing the pressure chamber with the vibrating plate therebetween; and an upper electrode that is formed at a surface of the piezoelectric body opposite the surface at which the lower electrode is formed, the upper electrode exhibiting another polarity, when viewed from a direction perpendicular to the surface of the lower electrode, the piezoelectric body being provided further toward an inner side than a peripheral wall of the pressure chamber, and the lower electrode being of a size such that one portion thereof overlaps with the peripheral wall of the pressure chamber, and being individuated per each piezoelectric body.

BRIEF DESCRIPTION OF THE DRAWINGS

Exemplary embodiments of the invention will be described in detail with reference to the following figures, wherein:

FIG. 13A is a plan view and FIG. 13B is a cross-sectional view;

FIG. 14A is a plan view and FIG. 14B is a cross-sectional view;

FIG. 15A is a plan view and FIG. 15B is a cross-sectional view.

DETAILED DESCRIPTION

Figure 1:
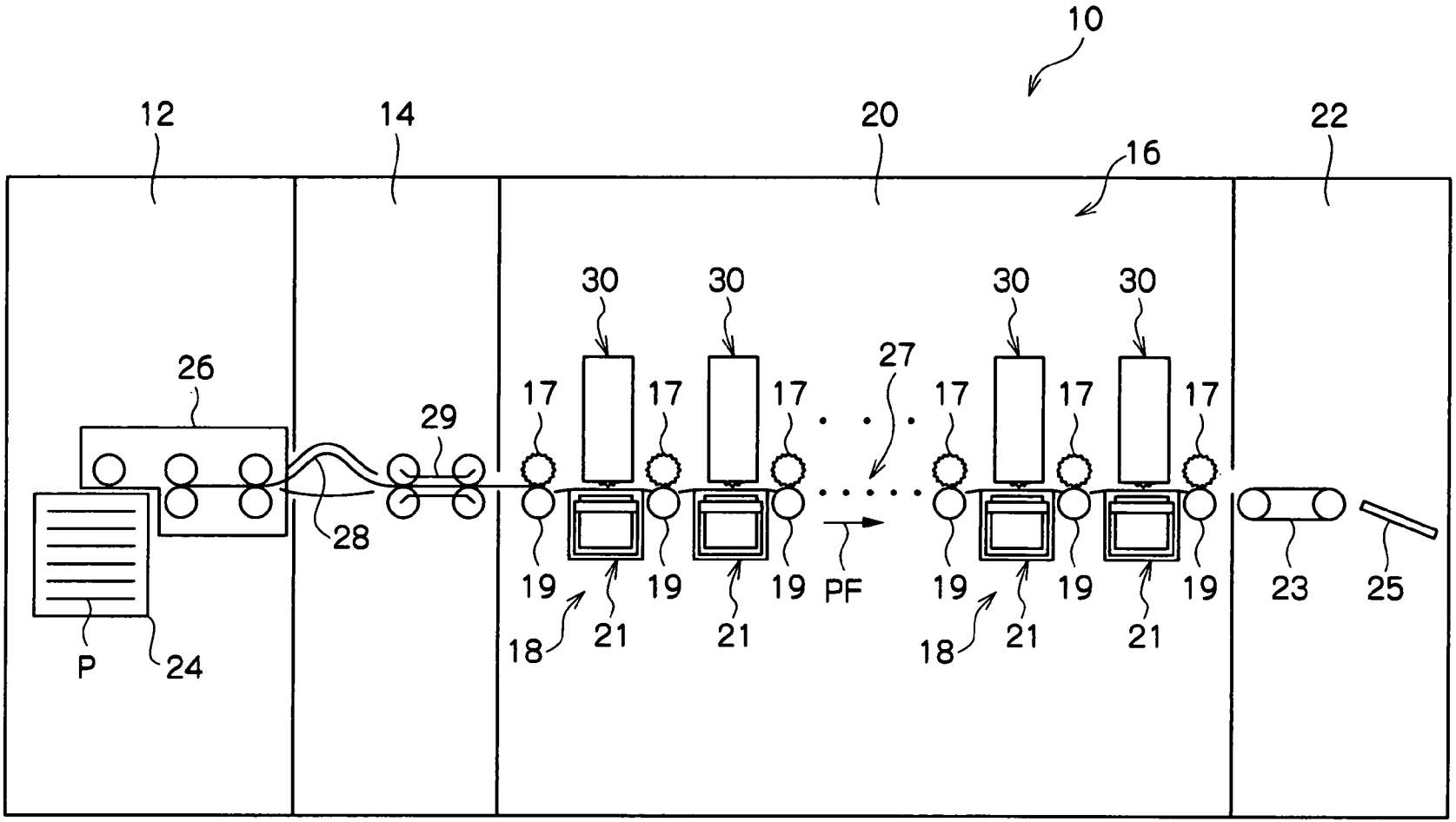
FIG. 1 is schematic front view showing an inkjet recording device relating to exemplary embodiments of the present invention.

Hereinafter, preferred exemplary embodiments of the present invention will be described in detail on the basis of the examples illustrated in the drawings. Note that description will be given by using an inkjet recording device 10 as an example of an image forming device. Accordingly, description is given with the liquid being an ink 110, and the liquid droplet ejecting head being an inkjet recording head 32. Further, description is given with the recording medium being a recording sheet P.

As shown in FIG. 1, the inkjet recording device 10 is basically structured from a sheet supplying section 12 which feeds-out the recording sheet P; a registration adjusting section 14 for controlling the posture of the recording sheet P; a recording section 20 including a recording head portion 16 which ejects ink droplets and forms an image on the recording sheet P, and a maintenance portion 18 which carries out maintenance of the recording head portion 16; and a discharging section 22 discharging the recording sheet P on which an image has been formed at the recording section 20.

The sheet supplying section 12 is structured with a stocker 24 in which the recording sheets P are layered and stocked, and a conveying device 26 which pulls the recording sheet P one-by-one from the stocker 24 and conveys it to the registration adjusting section 14. The registration adjusting section 14 includes a loop forming portion 28 and a guide member 29 which controls the posture of the recording sheet P. Due to the recording sheet P passing through this section, the skew is corrected by utilizing the stiffness of the recording sheet P, and the conveying timing is controlled, and the recording sheet P is supplied to the recording section 20. Further, via a sheet discharging belt 23, the discharging section 22 accommodates the recording sheet P, on which an image has been formed at the recording section 20, at a tray 25.

A sheet conveying path 27 along which the recording sheet P is conveyed is structured between the recording head portion 16 and the maintenance portion 18 (the sheet conveying direction is shown by arrow PF). The sheet conveying path 27 includes star wheels 17 and conveying rollers 19, and continuously (without stoppage) conveys the recording sheet P while nipping the recording sheet P between the star wheels 17 and the conveying rollers 19. Ink droplets are ejected from the recording head portion 16 onto the recording sheet P, and an image is formed on the recording sheet P. The maintenance portion 18 includes maintenance devices 21 which are disposed so as to oppose inkjet recording units 30, and carries out processings such as capping, wiping, preliminary ejecting, suctioning, and the like on the inkjet recording heads 32 (see FIG. 2).

Figure 2:
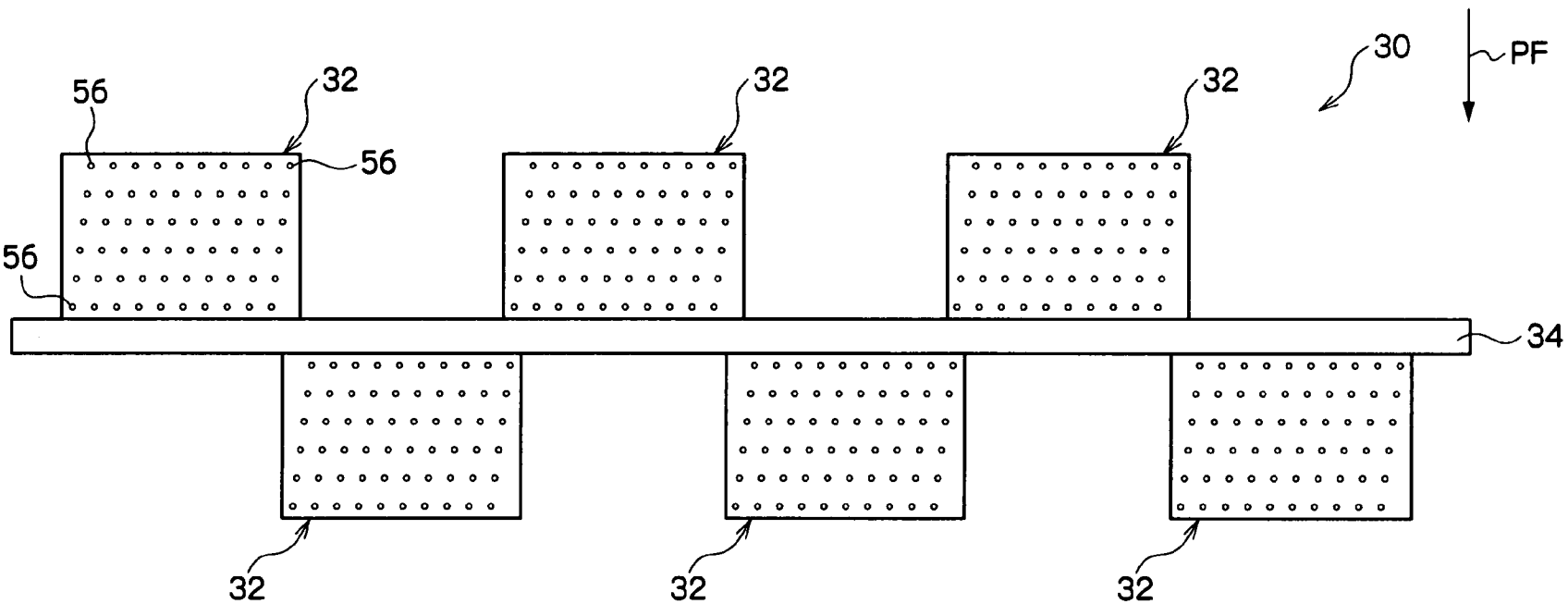
FIG. 2 is an explanatory drawing showing an array of inkjet recording heads relating to the exemplary embodiments of the present invention.

As shown in FIG. 2, each inkjet recording unit 30 includes a supporting member 34 which is disposed in a direction orthogonal to the sheet conveying direction shown by arrow PF. Plural inkjet recording heads 32 are mounted to the supporting member 34. Plural nozzles 56 are formed in the form of a matrix at the inkjet recording head 32, such that the nozzles 56 are lined-up at a uniform pitch in the transverse direction of the recording sheet P as the overall inkjet recording unit 30.

An image is recorded on the recording sheet P by ink droplets being ejected from the nozzles 56 onto the recording sheet P which is conveyed continuously along the sheet conveying path 27. Note that at least four of the inkjet recording units 30 are disposed in correspondence with the respective colors of yellow (Y), magenta (M), cyan (C), and black (K) in order to record a so-called full-color image for example.

Figure 3:
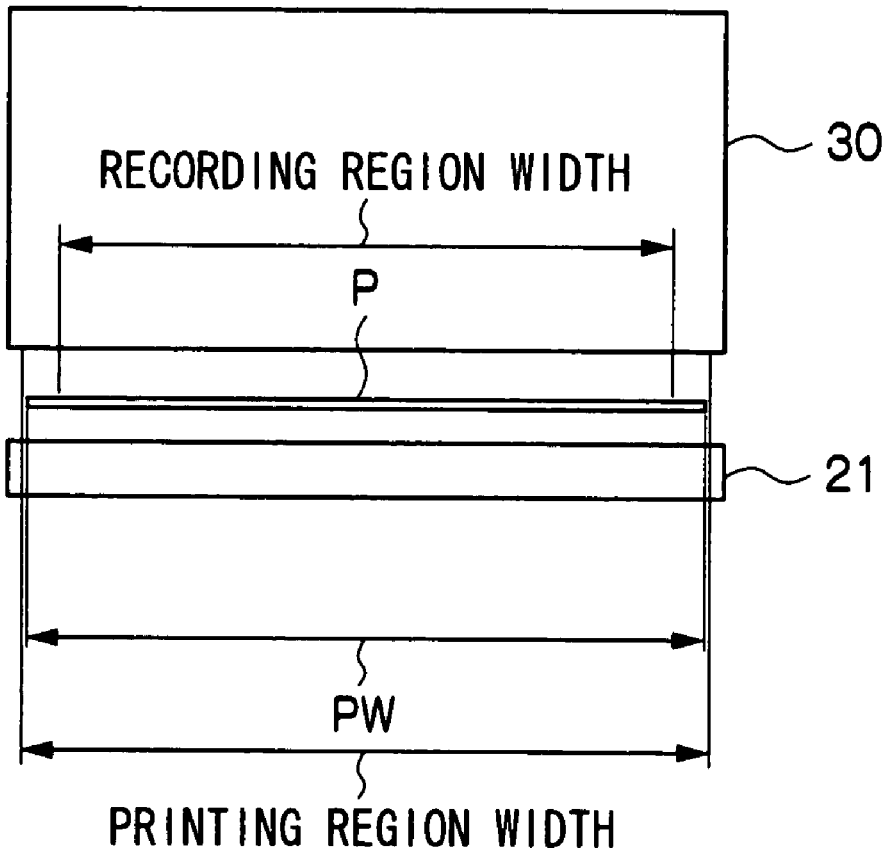
FIG. 3 is an explanatory drawing showing the relationship between the width of a recording medium and the width of a printing region of the inkjet recording head relating to the exemplary embodiments of the present invention.

As shown in FIG. 3, the width of the printing region by the nozzles 56 of each inkjet recording unit 30 is longer than a maximum sheet width PW of the recording sheet P for which image recording at the inkjet recording device 10 is supposed, such that image recording over the entire width of the recording sheet P is possible without moving the inkjet recording unit 30 in the transverse direction of the sheet.

Here, the basic printing region width is the maximum width among recording regions from which margins, at which printing is not carried out, are subtracted from the both ends of the recording sheet P, and generally, is larger than the maximum sheet width PW which is the object of printing. This is because there is the concern that the recording sheet P will be conveyed while inclined at a predetermined angle with respect to the conveying direction (i.e., while skewed), and because the demand for borderless printing is high.

Figure 4:
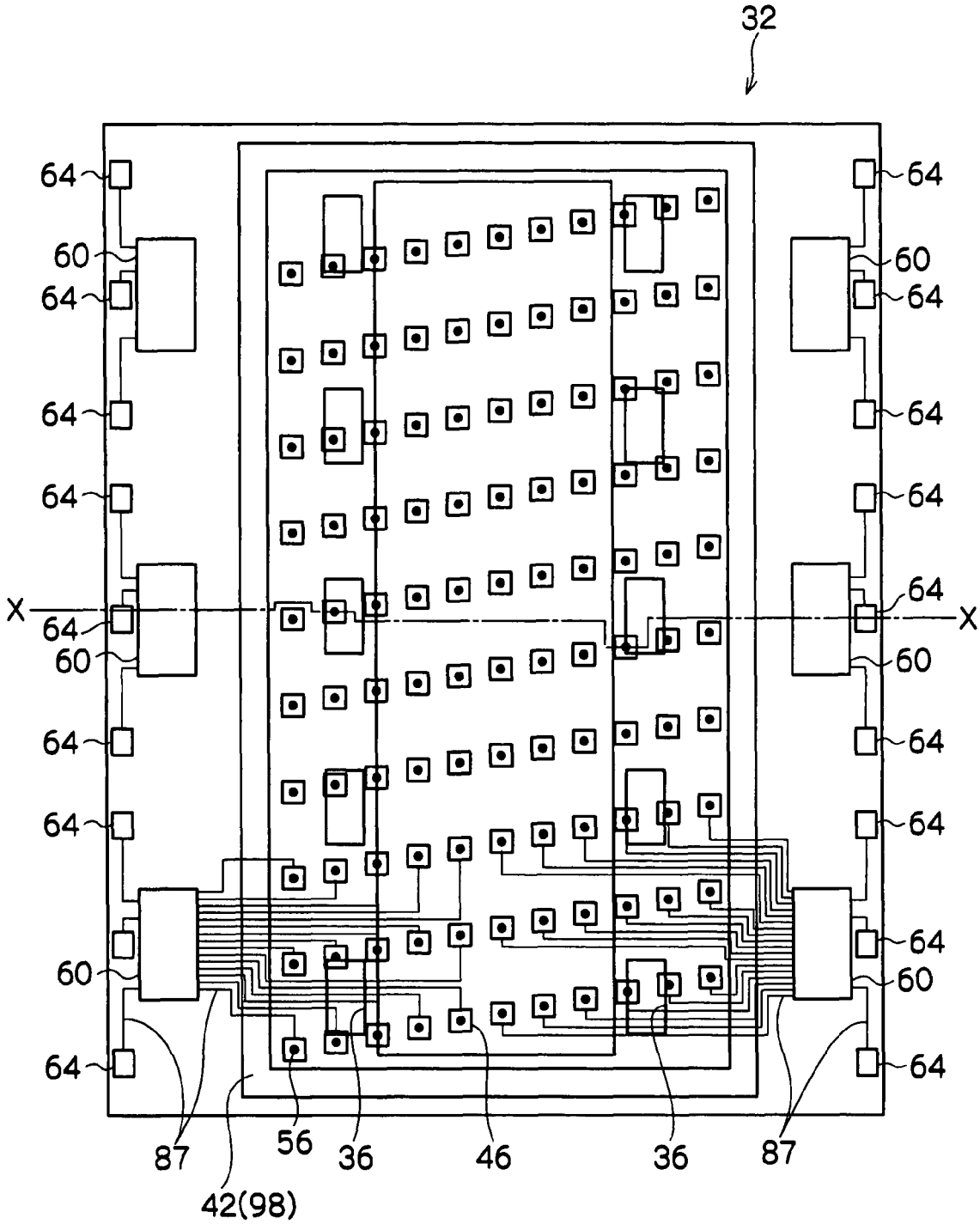
FIG. 4 is a schematic plan view of the inkjet recording head relating to the exemplary embodiments of the present invention.
Figure 5:
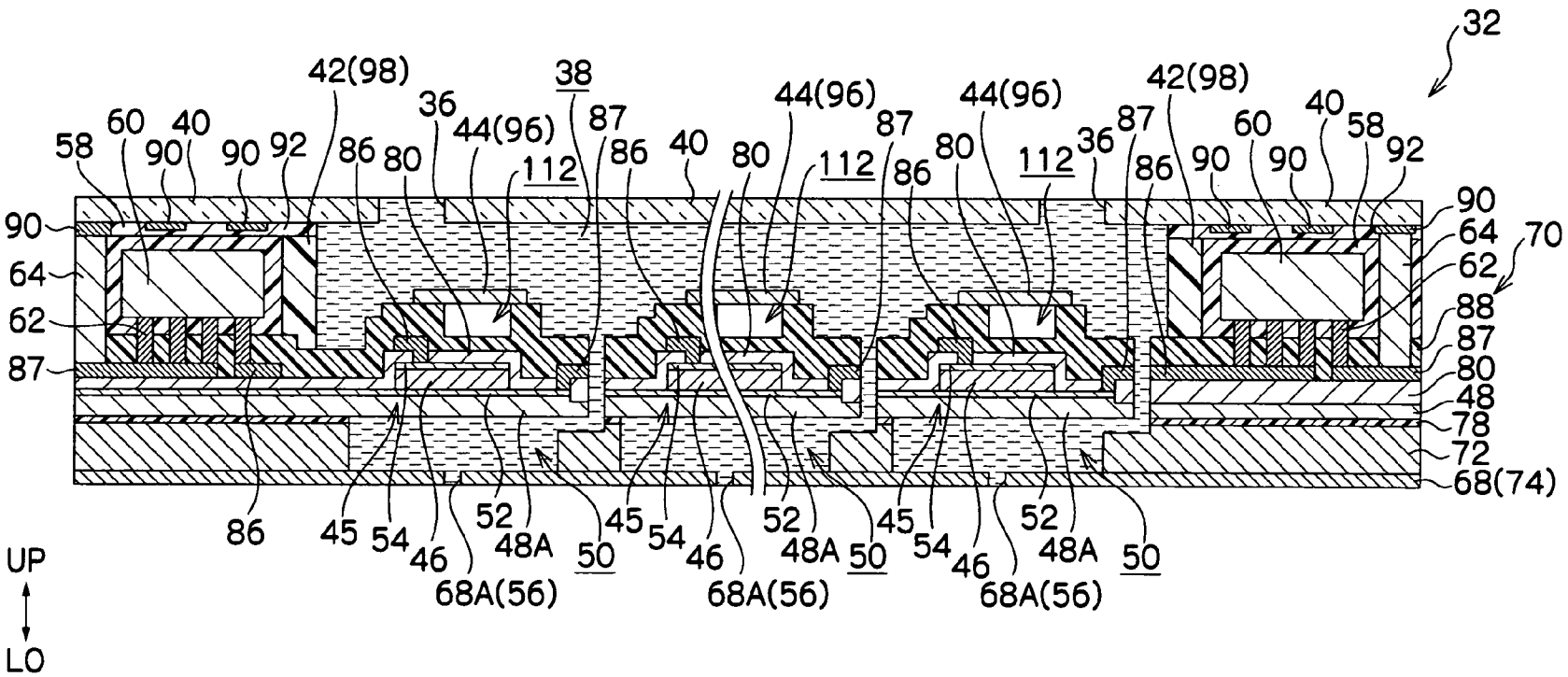
FIG. 5 is a cross-sectional view along line X-X in FIG. 4.
Figure 6:
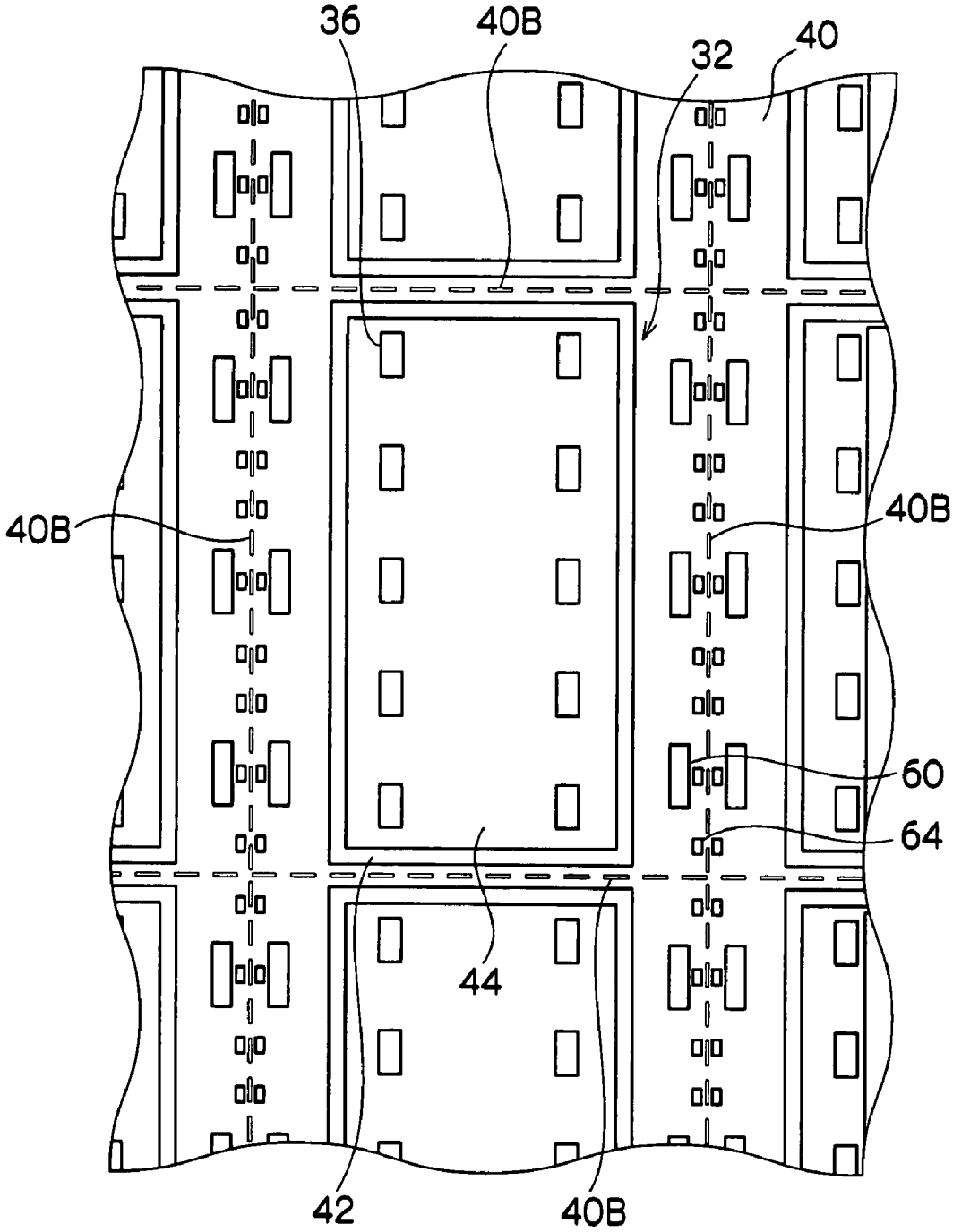
FIG. 6 is a schematic plan view showing a ceiling plate before being cut into the inkjet recording heads relating to the exemplary embodiments of the present invention.

Next, the inkjet recording head 32 in the inkjet recording device 10 of the above-described structure will be described in detail. Note that FIG. 4 is a schematic plan view showing the overall structure of the inkjet recording head 32, and FIG. 5 is a cross-sectional view along line X-X in FIG. 4. Further, FIG. 6 is a schematic plan view showing a ceiling plate 40 before being cut into the inkjet recording heads 32.

As shown in FIG. 4 and FIG. 5, ink supply ports 36, which are connected to an ink tank (not shown), are provided at the inkjet recording head 32. The ink 110, which is injected-in from these ink supply ports 36, is stored in an ink pooling chamber 38.

The volume of the ink pooling chamber 38 is regulated by the ceiling plate 40 and a partitioning wall 42. Plural ink supply ports 36 are formed in lines at predetermined places of the ceiling plate 40. Further, air dampers 44 (a photosensitive dry film 96 which will be described later), which are made of resin and mitigate pressure waves, are provided in the ink pooling chamber 38, further toward the inner side than the ceiling plate 40 and between the ink supply ports 36 which form the lines.

Any material, such as glass, ceramic, silicon, resin, or the like for example, may be used as the material of the ceiling plate 40, provided that it is an insulator which has strength such that it can become the support of the inkjet recording head 32. Further, metal wires 90, which are for energizing driving ICs 60 which will be described later, are provided at the ceiling plate 40. The metal wires 90 are covered and protected by a resin film 92, such that erosion of the metal wires 90 by the ink 110 is prevented.

The partitioning wall 42 is molded of resin (a photosensitive dry film 98 which will be described later), and partitions the ink pooling chamber 38 into a rectangular shape. Further, the ink pooling chamber 38 is separated vertically from the pressure chambers 50 via the piezoelectric elements 45 and vibrating plates 48 which are flexurally deformed in the vertical direction by the piezoelectric elements 45. Namely, the piezoelectric elements 45 and the vibrating plates 48 are structured so as to be disposed between the ink pooling chamber 38 and the pressure chambers 50, and the ink pooling chamber 38 and the pressure chambers 50 are structured so as to not exist on the same horizontal plane.

Accordingly, the pressure chambers 50 can be disposed in states of being near to one another, and the nozzles 56 can be disposed at a high density in the form of a matrix. The vibrating plate 48 is a three-layer structure formed by $SiO_2$ films, to which no impurities are added, being layered on and beneath a silicon oxide film ($SiO_2$ film) to which germanium (Ge) is added, by Plasma-Chemical Vapor Deposition (P-CVD). The vibrating plate 48 is elastic at least in the vertical direction. When the piezoelectric element 45 is energized (i.e., when voltage is applied to the piezoelectric element 45), the vibrating plate 48 flexurally deforms (is displaced) in the vertical direction. Other than this, a layered film of silicon and silicon oxide films, or the like, may be used as the vibrating plate. In this case, the vibrating plate is fabricated by using an SOI wafer as the base substrate. Note that the thickness of the vibrating plate 48 is greater than or equal to 1 μm and less than or equal to 20 μm (1 μm to 20 μm) in order to obtain stable rigidity.

The piezoelectric element 45 is adhered to the top surface of the vibrating plate 48, at each of the pressure chambers 50. Lower electrodes 52, which are one polarity of the piezoelectric elements 45, are disposed at the bottom surfaces of piezoelectric bodies 46 structuring the piezoelectric elements 45. Upper electrodes 54, which are the other polarity, are disposed on the top surfaces of the piezoelectric bodies 46.

Here, the piezoelectric body 46 and the upper electrode 54 are provided at the inner side of the peripheral (surrounding) wall (a silicon substrate 72 which will be described later) of the pressure chamber 50. The lower electrodes 52 are provided individually at each piezoelectric body 46. Further, the lower electrodes 52 is of a size such that a longitudinal direction one end portion of the lower electrode 52 reaches a peripheral wall of the pressure chamber 50 (the longitudinal direction one end portion of the lower electrode 52 overlaps with the peripheral wall).

The upper electrodes 54, the piezoelectric bodies 46, and the lower electrodes 52 are covered and protected by a low water permeable insulating film (hereinafter called "SiOx film") 80 which serves as a protective film.

Further, the top surface of the low water permeable insulating film (SiOx film) 80 and metal wires 86, 87 are covered and protected by a resin protective film 88, such that erosion due to the ink 110 is prevented.

At the regions above the piezoelectric elements 45, the resin protective film 88 is formed to be thin. Further, the air damper 44 (the photosensitive dry film 96 which will be described later), which is formed of resin and mitigates pressure waves, is provided at the top surface of the resin protective film 88 positioned above the piezoelectric element 45, so as to oppose the piezoelectric element 45.

On the other hand, the driving ICs 60 are disposed at the outer sides of the ink pooling chamber 38 which is prescribed by the partitioning wall 42, and between the ceiling plate 40 and the vibrating plates 48. The driving ICs 60 are structured so as to not be exposed (not project out) from the vibrating plates 48 or the ceiling plate 40.

The peripheries of the driving ICs 60 are sealed by a resin material 58. Plural injection openings 40B for the resin material 58 which seals the driving ICs 60 are formed in the ceiling plate 40 in the manufacturing step shown in FIG. 6, in a grid-like form so as to partition the respective inkjet recording heads 32. After the forming of a piezoelectric element substrate 70 which will be described later, the ceiling plate 40 is cut along the injection openings 40B which are sealed (blocked) by the resin material 58. In this way, the plural inkjet recording heads 32, which include the nozzles 56 (see FIG. 4) in a matrix form, are manufactured at one time.

Figure 7:
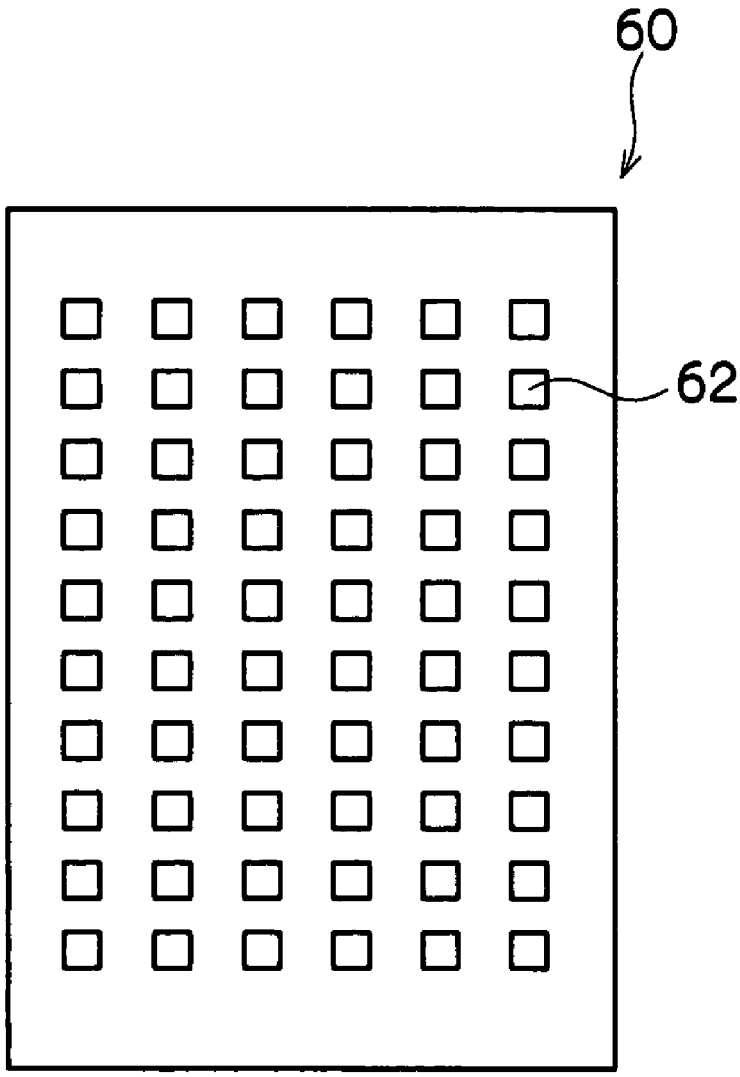
FIG. 7 is a schematic plan view showing bumps of a driving IC of the inkjet recording head relating to the exemplary embodiments of the present invention.

As shown in FIG. 5 and FIG. 7, plural bumps 62 project out by predetermined heights and in the form of a matrix at the bottom surface of the driving IC 60, and are flip-chip mounted to the metal wires 86, 87 disposed at the piezoelectric element substrate 70. Note that, here, the metal wires 86 which are connected to the upper electrodes 54 are ground potential (as will be described later).

Bumps 64 are provided at the outer sides of the driving ICs 60 in FIG. 5. The bumps 64 connect metal wires 90 provided at the ceiling plate 40, and the metal wires 87 provided at the piezoelectric element substrate 70. The bumps 64 are of course provided so as to be higher than the heights of the driving ICs 60 mounted on the piezoelectric element substrate 70.

Accordingly, the metal wires 90 of the ceiling plate 40 are energized from the main body of the inkjet recording device 10, and the metal wires 87 are energized from the metal wires 90 of the ceiling plate 40 via the bumps 64, and the driving ICs 60 are energized therefrom. Voltages are applied to the piezoelectric elements 45 at predetermined times by the driving ICs 60, such that the vibrating plates 48 are flexurally deformed in the vertical direction. The ink 110 filled in the pressure chamber 50 is thereby pressurized, and ink droplets are ejected from the nozzles 56.

One nozzle 56 which ejects the ink droplets is provided for each pressure chamber 50, at a predetermined position thereof. The pressure chamber 50 and the ink pooling chamber 38 are connected by an ink flow path 66 and a communicating path 115 being connected. The ink flow path 66 sidesteps the piezoelectric element 45 and passes through the vibrating plate 48. The communicating path 115 extends horizontally in FIG. 5 from the pressure chamber 50.

Figure 8:
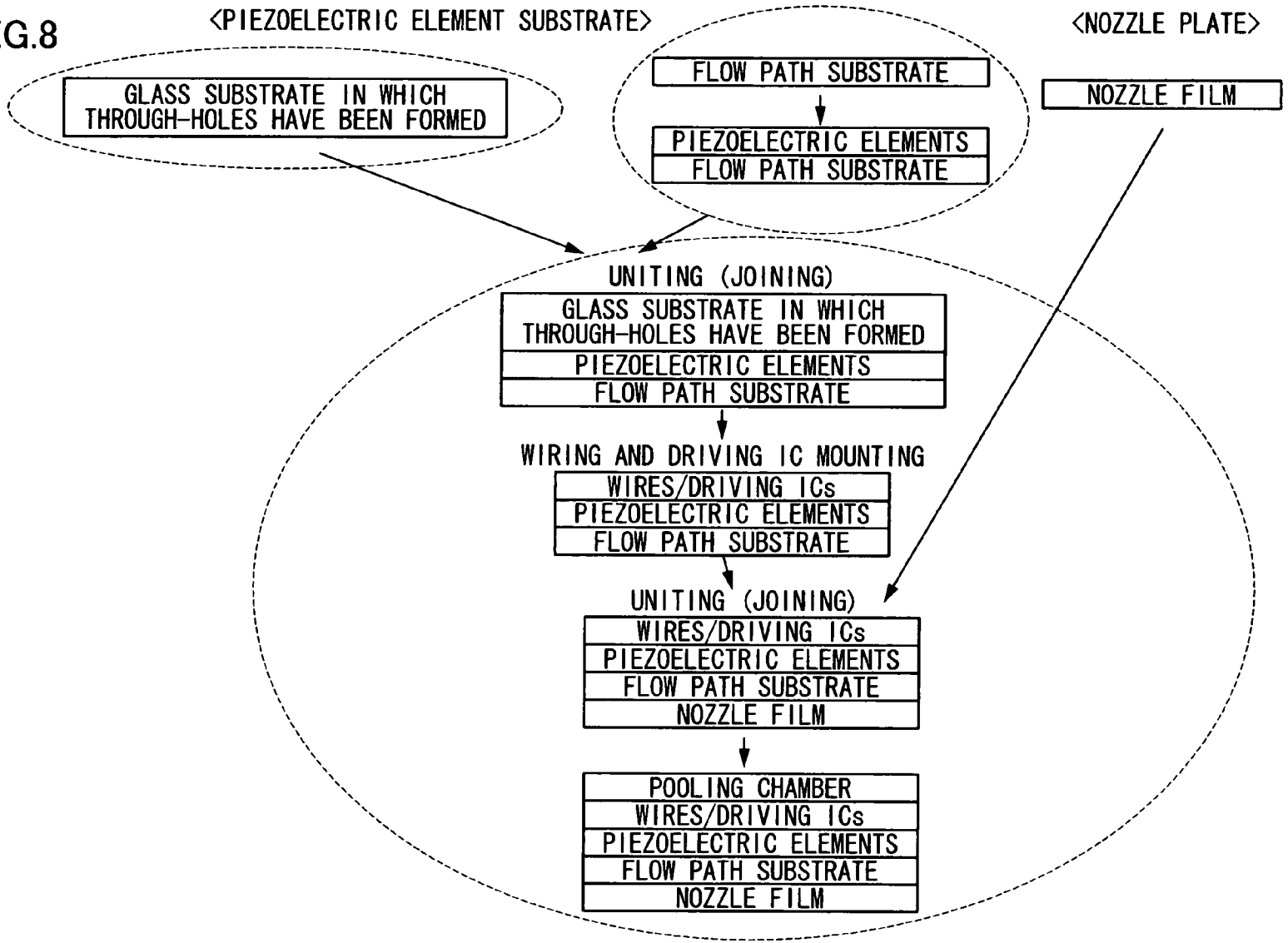
FIG. 8 is an explanatory drawing showing the overall process of manufacturing the inkjet recording head relating to the exemplary embodiments of the present invention.

Next, the manufacturing processes of the inkjet recording head 32, which is structured as described above, will be described in detail on the basis of FIG. 8 through FIGS. 11A and 11B. As shown in FIG. 8, the inkjet recording head 32 is manufactured by fabricating the piezoelectric element substrate 70, which is provided with the piezoelectric elements 45, on the top surface of the silicon substrate 72 which is a flow path substrate, and then joining (affixing) a nozzle plate 74 (a nozzle film 68) to the bottom surface of the silicon substrate 72.

Figures 9A, 9B, 9C, 9D:
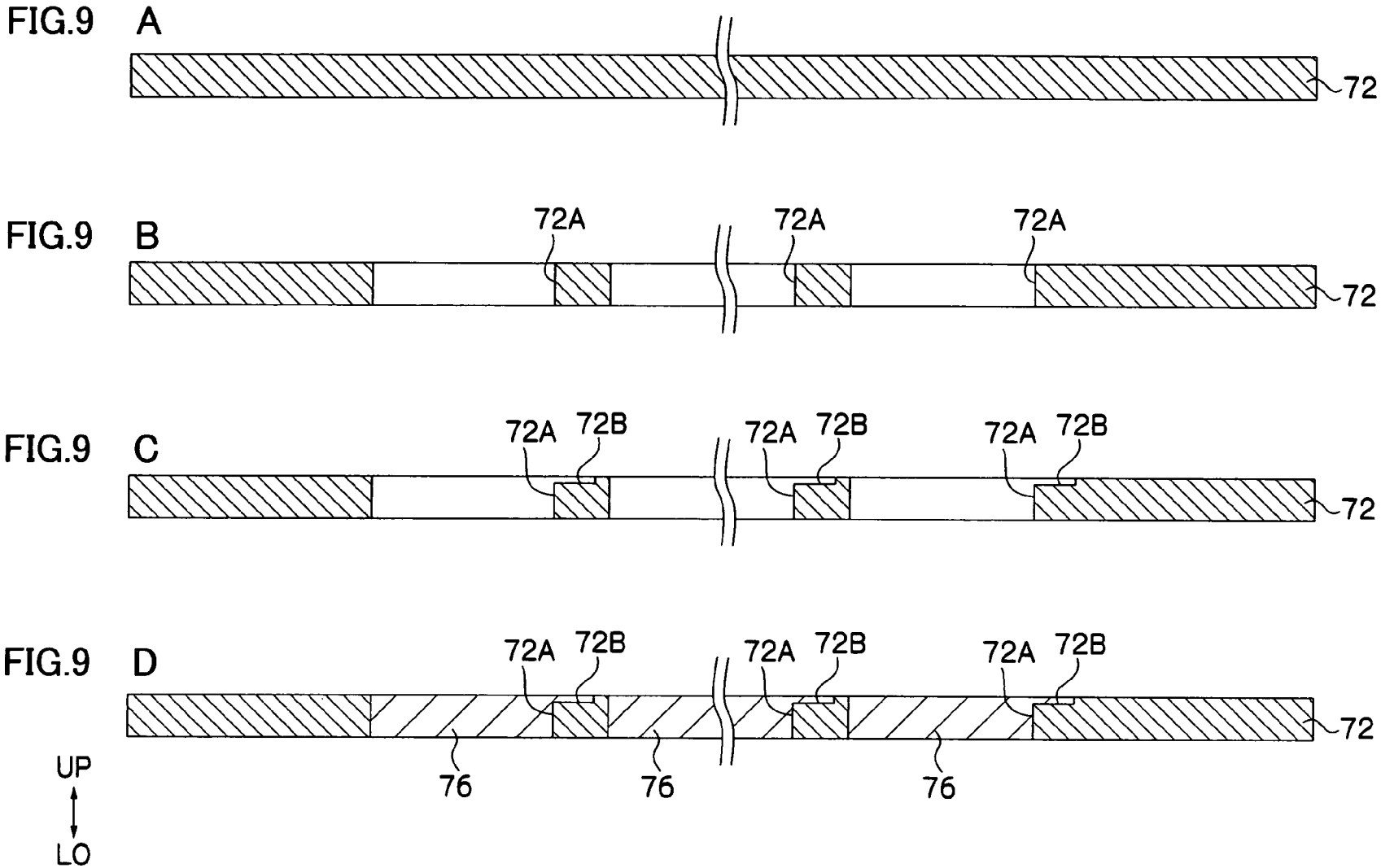
FIGS. 9A through 9P are explanatory drawings showing processes of manufacturing a piezoelectric element substrate on a silicon substrate of the inkjet recording head relating to the exemplary embodiments of the present invention.

As shown in FIG. 9A, first, the silicon substrate 72 is readied. Then, as shown in FIG. 9B, opening portions 72A are formed in regions of the silicon substrate 72 which become the pressure chambers 50, by Reactive Ion Etching (RIE). Specifically, it is carried out by resist formation by photolithography, patterning (exposing and developing), etching by RIE, and resist removal by oxygen plasma.

Next, as shown in FIG. 9C, groove portions 72B are formed by RIE at regions of the silicon substrate 72 which become the communicating paths 115. Specifically, in the same way as described above, it is carried out by resist formation by photolithography, patterning (exposing and developing), etching by RIE, and resist removal by oxygen plasma. In this way, the multi-step structure formed from the pressure chamber 50 and the communicating path 115 is formed.

Thereafter, as shown in FIG. 9D, a glass paste 76 is filled (buried) by screen printing method into the opening portions 72A which structure the pressure chambers 50, and the groove portions 72B which structure the communicating paths 115. Using screen printing method is preferable because the glass paste 76 can reliably be buried even into the deep opening portions 72A and groove portions 72B.

The thermal expansion coefficient of this glass paste 76 is $1\times10^{-6}$/° C. to $6\times10^{-6}$/° C., and the softening point thereof is 550° C. to 900° C.

After the filling of the glass paste 76, the silicon substrate 72 is subjected to heating processing, for example, at 800° C. for 10 minutes. The temperature which is used in the curing by heat treatment of the glass paste 76 is a temperature which is higher than the film forming temperature of the piezoelectric elements 45 (e.g., 550° C.) and the film forming temperature of the vibrating plate 48 (e.g., 700° C.) which will be described later. The glass paste 76 is made to be resistant to the high temperatures in the film forming (deposition) processes of the vibrating plate 48 and the piezoelectric elements 45.

Namely, temperatures up to the temperature at which at least the glass paste 76 is cured by heat treatment can be used in later processes. Thereafter, the top surface (obverse) of the silicon substrate 72 is polished and the excess glass paste 76 is removed, such that the top surface (obverse) is planarized.

Figures 9E, 9F, 9G, 9H, 9I:
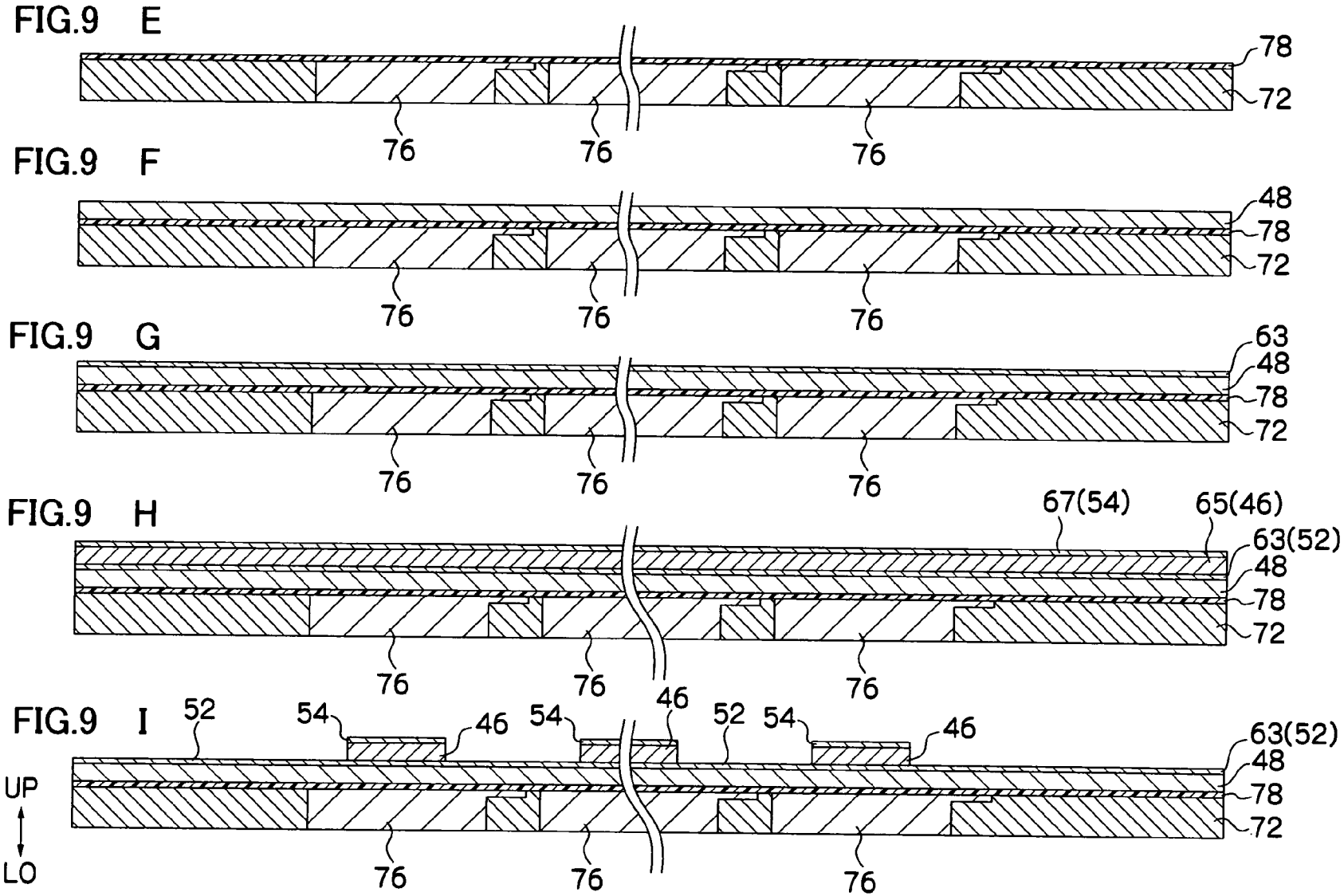

Next, as shown in FIG. 9E, a germanium (Ge) film 78 (film thickness: 1 μm) is film-formed by sputtering on the top surface (obverse) of the silicon substrate 72. This Ge film 78 functions as an etching stopper layer which, when the glass paste 76 is removed by etching by a hydrogen fluoride (HF) solution in a later process, protects such that the vibrating plates 48 ($SiO_2$ film) are not etched together therewith. Note that the Ge film 78 can also be film-formed by vapor deposition or CVD. Further, a silicon (Si) film also can be used as the etching stopper layer.

Then, as shown in FIG. 9F, the thin film which becomes portions of the vibrating plates 48, i.e., the $SiO_2$ film (film thickness: 0.4 μm) to which no impurities are added, is film-formed on the top surface of the Ge film 78 by P-CVD. Next, the thin film which becomes portions of the vibrating plates 48, i.e., the $SiO_2$ film (film thickness: 9.2 μm) to which Ge is added, is film-formed by P-CVD. Further, the thin film which becomes portions of the vibrating plates 48, i.e., the $SiO_2$ film (film thickness: 0.4 μm) to which no impurities are added, is film-formed by P-CVD.

Specifically, film-formation is carried out by adding tetramethyl germanium (TMGe) which is an alkoxide gas to a gas containing oxygen ($O_2$) and silicon (Si) raw materials, e.g., a gas containing any of tetraethoxysilane (TEOS), tetramethoxysilane (TMOS), or silane ($SiH_4$). Note that, at this time, the thickness of the $SiO_2$ film to which Ge is added is made to be greater than or equal to ½ of the entire thickness of the vibrating plate 48. Note that Si, SiN, or the like may be used, instead of $SiO_2$, as the material structuring the vibrating plate 48.

When the $SiO_2$ films have been continuously film-formed in this way, they are annealed (thermally processed) in a nitrogen ($N_2$) atmosphere for one hour at a temperature, e.g., 700° C., which is higher than the maximum temperature in the processes thereinafter. Note that the annealing temperature is not limited to 700° C., and it suffices for the annealing temperature to be greater than or equal to 600° C. and less than or equal to 1100° C. (600° C. through 1100° C.).

When the $SiO_2$ films are film-formed and annealed such that the vibrating plate 48 of the three-layer structured is formed, as shown in FIG. 9G, a layered film (lower electrode layer) 63 of Ir and Ti and a thickness of about 0.5 μm for example, is film-formed on the top surface of the vibrating plate 48 by sputtering.

Then, as shown in FIG. 9H, a PZT film (piezoelectric body layer) 65 which is the material of the piezoelectric bodies 46, is layered (film-formed) by sputtering on the top surface of the layered film 63 which will become the lower electrodes 52 (piezoelectric body layer forming step). Thereafter, an Ir film (upper electrode layer) 67 which will become the upper electrodes 54 is layered (film-formed) by sputtering (upper electrode layer forming step). Thereafter, as shown in FIG. 9I, patterning is carried out for the PZT film 65 and the Ir film 67, and the piezoelectric bodies 46 and the upper electrodes 54 are formed (piezoelectric body patterning step).

Specifically, it is carried out by sputtering of the PZT film (film thickness: 5 μm), sputtering of the Ir film (film thickness: 0.5 μm), resist formation by photolithography, etching (dry etching using a $Cl_2$ or an F gas), and resist removal by oxygen plasma. The materials of the lower electrodes 52 and the upper electrodes 54 have high affinity with the PZT material which is the piezoelectric bodies 46, and are heat-resistant. Examples include Ir, Ru, Pt, Ta, and $IrO_2$, $RuO_2$, $PtO_2$, $TaO_4$, and the like which are oxides thereof. Further, the film-forming temperature of the PZT film 65 is 550° C., and an AD method, a sol-gel method, or the like also can be used in the layering (film-forming) of the PZT film 65.

Figure 9J:
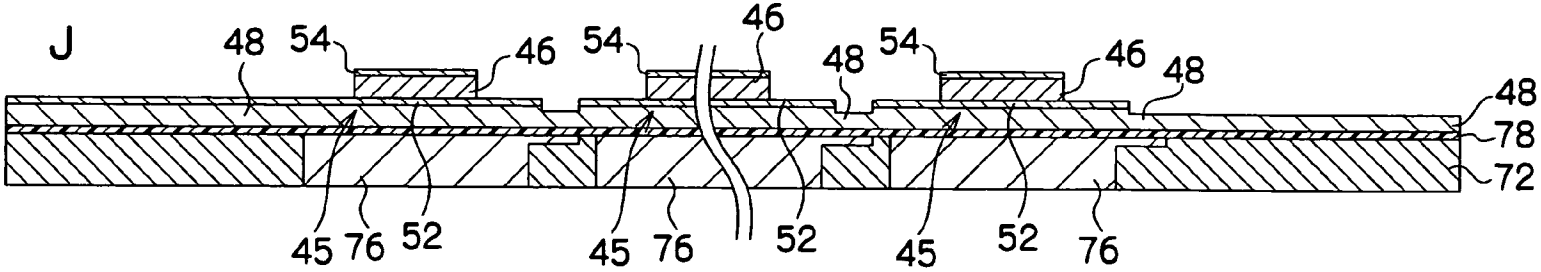

Next, as shown in FIG. 9J, patterning is carried out for the layered film 63 which is layered on the top surface of the vibrating plate 48 (lower electrode patterning step). Specifically, it is carried out by resist formation by photolithography, dry etching (using a $Cl_2$ gas) by RIE, and resist removal by oxygen plasma.

In this way, in the process of forming the piezoelectric elements 45, the vibrating plate 48 is formed of $SiO_2$ at the silicon substrate 72, and the layered film 63 (lower electrodes 52) of Ir and Ti are formed on the top surface thereof. Then, the PZT film 65 (piezoelectric bodies 46) is formed on the top surface of the layered film 63, and the Ir film 67 (the upper electrodes 54) is formed on the top surface of the PZT film 65, such that a plate of a five-layer structure is formed. Then, the piezoelectric elements 45 are formed by respectively patterning the upper electrodes 54, the piezoelectric bodies 46, and the lower electrodes 52.

Figure 9K:
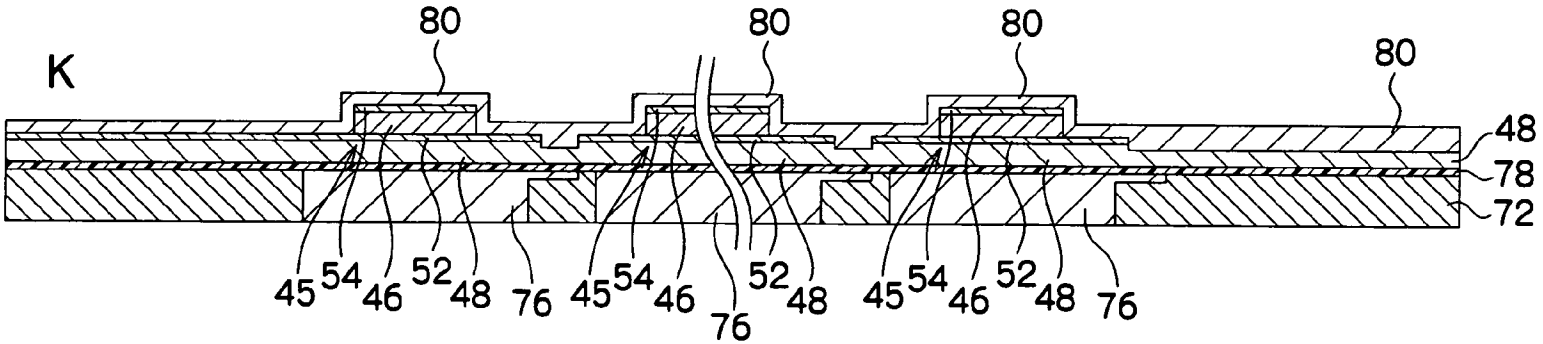

Next, as shown in FIG. 9K, the low water permeable insulating film (SiOx film) 80 is layered as a protective film on the top surfaces of the upper electrodes 54, the end surfaces of the piezoelectric bodies 46, the top surfaces of the lower electrodes 52, and the end surfaces of the vibrating plate 48, which are exposed at the surface.

Note that, although the SiOx film 80 (silicon oxide film) is used as the protective film in this case, an SiNx film (silicon nitride film), an SiOxNy film, or the like may be used. Further, SOG (Spin-On-Glass), a metal film of Ta, Ti, or the like, a metal oxide film of $TaO_2$, $Ta_2O_5$ or the like, a resin film, or the like may be used. The protective film may be a single layer film of any of these, or a multilayer film combining these. Oxide films, nitride films, SOG, metal films, and metal oxide films have excellent insulating ability, moisture-resistance, and an ability to suppress (mitigate) steps between the film layers, and thereamong, oxide films, nitride films, SOG and metal films have excellent chemical (ink) resistance as well.

Figure 9L:
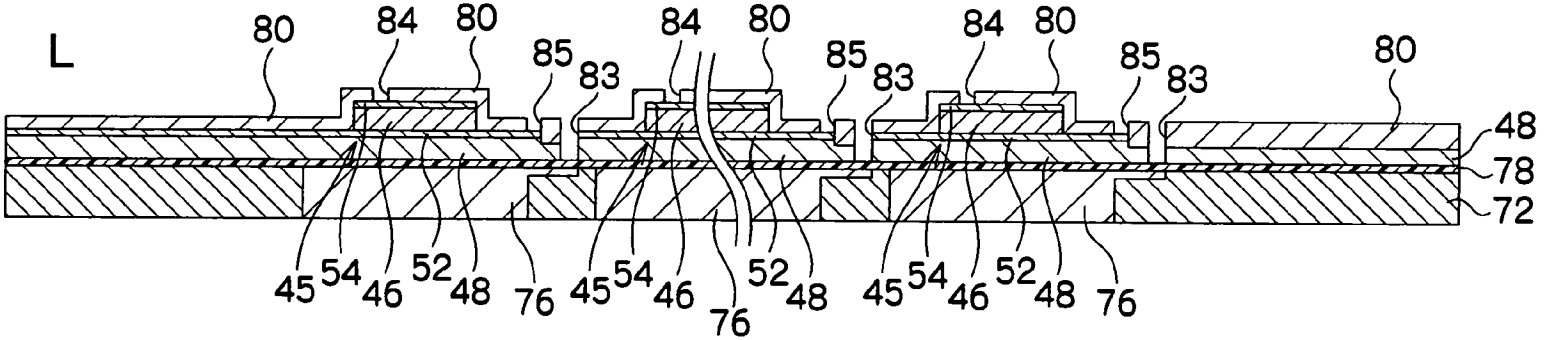

Then, as shown in FIG. 9L, ink supply openings 83 which structure the ink flow paths 66, which connect the ink pooling chamber 38 and the communicating paths 115 which extend horizontally in FIG. 5 from the pressure chambers 50, are formed by dry etching. Further, openings 84 (contact holes), for connecting the metal wires 86 (see FIG. 5) to the upper electrodes 54, and openings 85 (contact holes), for connecting the metal wires 87 to the lower electrodes 52, are formed by dry etching.

Figure 9M:
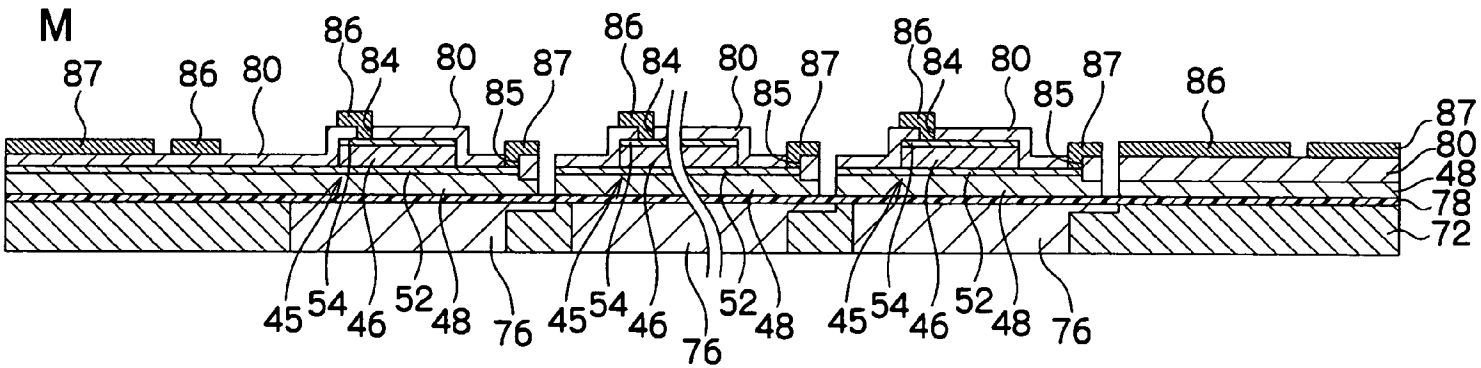

Next, as shown in FIG. 9M, a metal film is layered on the top surfaces of the upper electrodes 54 within the openings 84, the lower electrodes 52 within the openings 85, and the low water permeable insulating films (SiOx films) 80, and the metal wires 86, 87 are patterned. Specifically, the processes of deposition of an Al film (thickness: 1 μm) by sputtering, resist formation by photolithography, etching of the Al film by RIE using a chlorine gas, and removal of the resist film by oxygen plasma, are carried out.

Figure 9N:
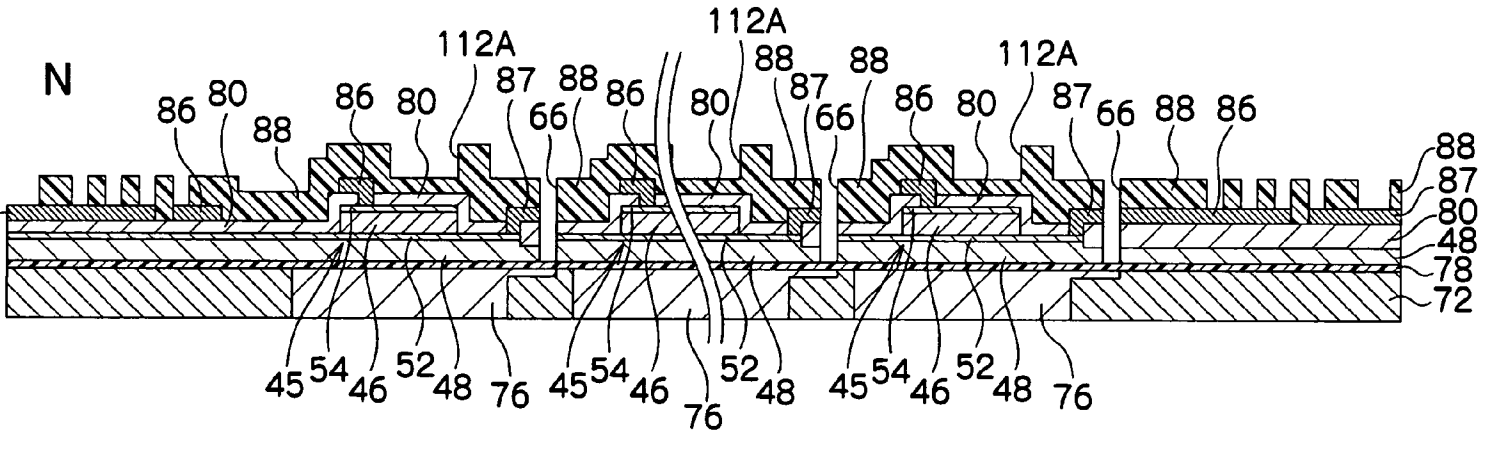

Then, as shown in FIG. 9N, the resin protective film 88 is patterned on the top surfaces of the metal wires 86, 87 and the SiOx film 80. Specifically, a photosensitive resin which structures the resin protective film 88 is coated on the SiOx film, and a pattern is formed by exposure and development, and finally, curing is carried out. At this time, the ink flow paths 66 also are formed in the resin protective film 88. Further, it suffices for the photosensitive resin which structures the resin protective film 88 to be ink resistant, such as a polyimide resin, a polyamide resin, an epoxy resin, a polyurethane resin, a silicone resin, or the like. Moreover, at this time, above the piezoelectric elements 45, the resin protective film 88 is formed to be thin at the regions where the metal wires 86 are not patterned. To this end, after the resin protective film 88 is formed, concave portions 112A are formed at predetermined regions by dry etching.

Note that the resin protective film 88 being of the same type of resin material as the partitioning wall 42 (the photosensitive dry film 98) which will be described later is preferable because the joining force to the partitioning wall 42 (the photosensitive dry film 98) is strong, and the penetration of the ink 110 from the boundary surfaces thereof is prevented even more, and, because the coefficients of thermal expansion thereof are substantially equal, there is also the advantage that little thermal stress arises.

Figure 9O:
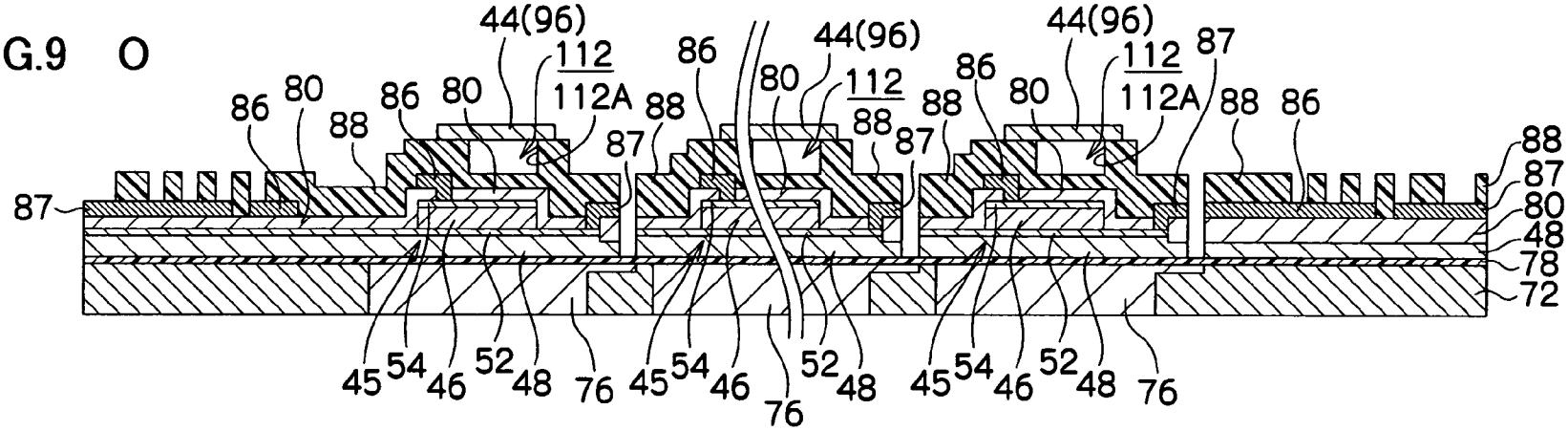

As shown in FIG. 9O, at the peripheral walls of the concave portions 112A, the photosensitive dry films 96 (e.g., Raytec FR-5025 manufactured by Hitachi Chemical Co., Ltd., thickness: 25 μm) are formed (bridged) by exposure and development so as to face the respective piezoelectric elements 45 which are arranged in the form of a matrix. These photosensitive dry films 96 become the air dampers 44 which mitigate pressure waves.

Figure 9P:
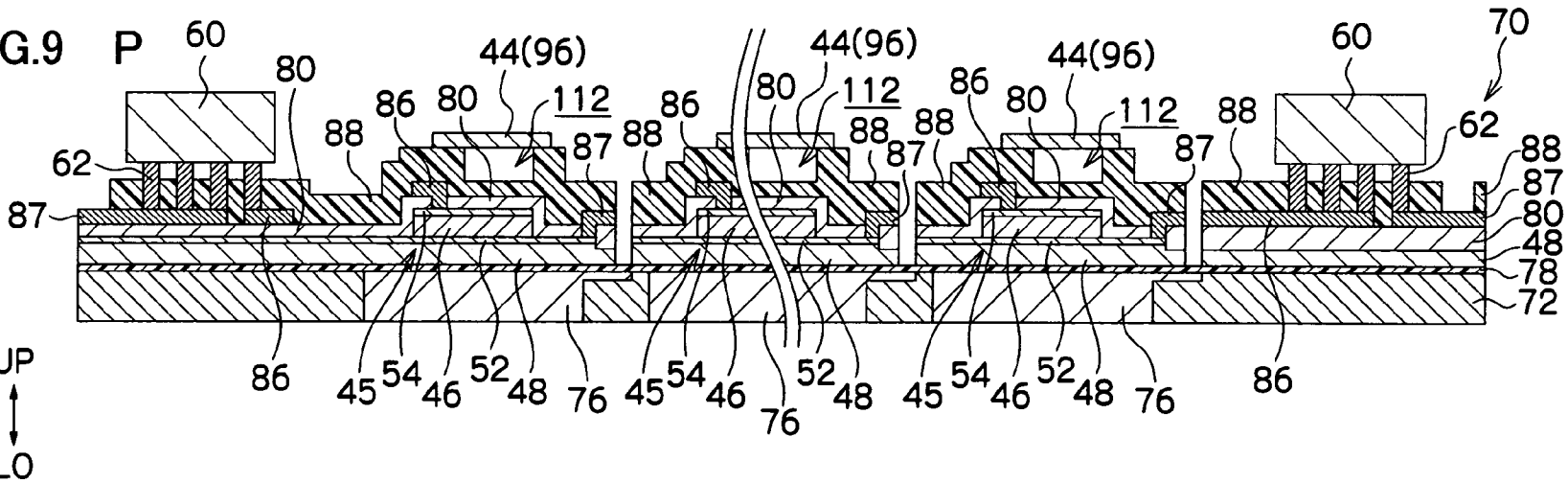

Next, as shown in FIG. 9P, the bumps 62 are formed at places where the resin protective film 88 is not layered and at which the metal wires 86, 87 are exposed, and the driving ICs 60 are flip-chip mounted via the bumps 62. At this time, the driving ICs 60 are machined to a predetermined thickness (70 μm to 300 μm) in a grinding process which is carried out in advance at the end of the semiconductor wafer process. If the driving ICs 60 are too thick, patterning of the partitioning wall 42 shown in FIG. 5 and formation of the bumps 64 become difficult. Electroplating, electroless plating, ball bumps, screen printing, and the like can be used as the method of forming the bumps 62 for flip-chip mounting the driving ICs 60 to the metal wires 86, 87. In this way, the piezoelectric element substrate 70 is fabricated.

Figure 10A:
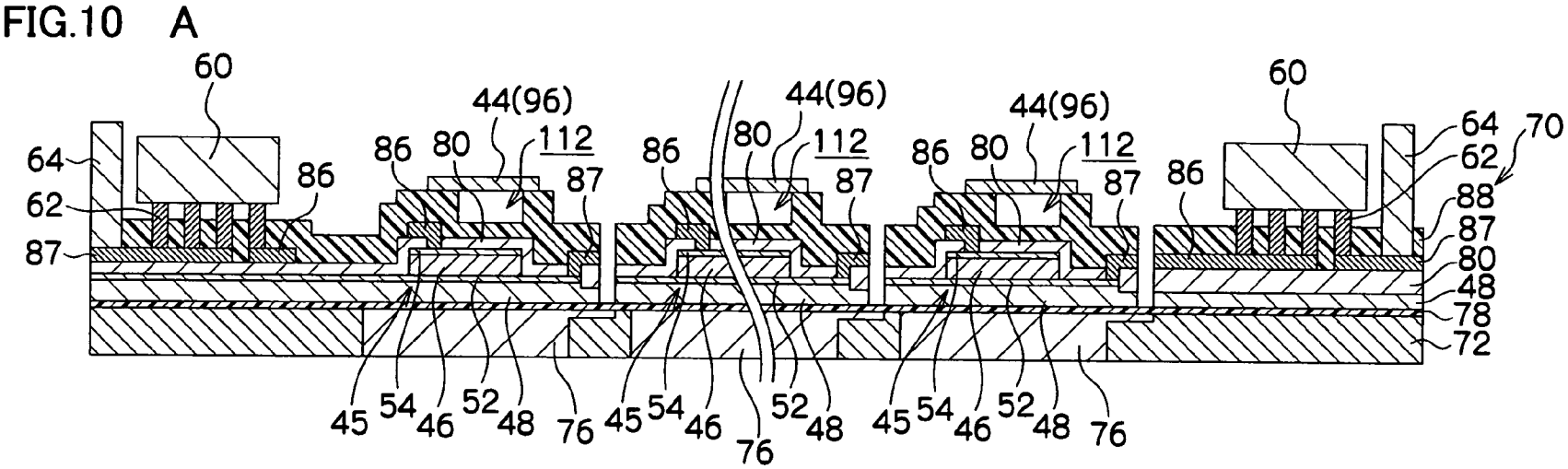
FIGS. 10A and 10F are explanatory drawings showing processes of manufacturing the piezoelectric element substrate on the silicon substrate of the inkjet recording head relating to the exemplary embodiments of the present invention.

Next, as shown in FIG. 10A, the bumps 64 are formed by plating or the like at places where the resin protective film 88 is not layered and the metal wires 87 are exposed. In order to electrically connect these bumps 64 to the metal wires 90 (see FIG. 5) provided at the ceiling plate 40, the heights of the bumps 64 are formed to be higher than that of the photosensitive dry film 98 (the partitioning wall 42) shown in FIG. 10B.

Figure 10B:
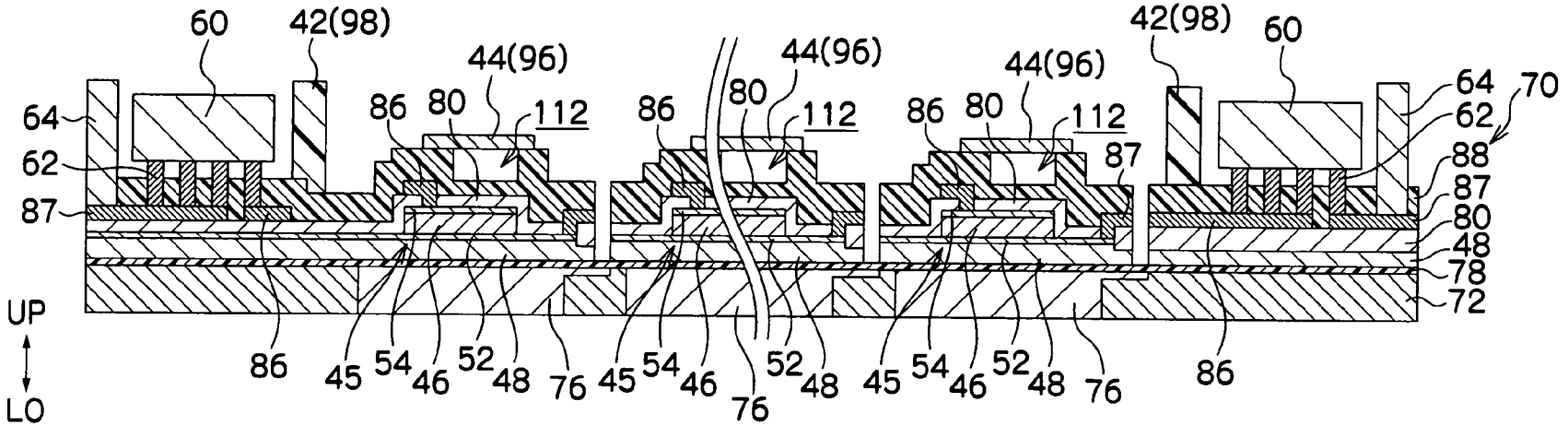
FIG. 10G is an explanatory drawing showing a process of joining the ceiling plate to the piezoelectric element substrate of the inkjet recording head relating to the exemplary embodiments of the present invention.

Then, as shown in FIG. 10B, the photosensitive dry film 98 (thickness: 100 μm) is layered on predetermined positions of the resin protective film 88, and is formed by exposure and development. This photosensitive dry film 98 becomes the partitioning wall 42 which prescribes the ink pooling chamber 38 (see FIG. 5). Note that the partitioning wall 42 is not limited to the photosensitive dry film 98, and may be a resin coated film (e.g., SU-8 resist manufactured by Kayaku MicroChem Corporation). At this time, it suffices for coating to be carried out by a spray coating device, and for exposure and development to be carried out.

Figure 10C:
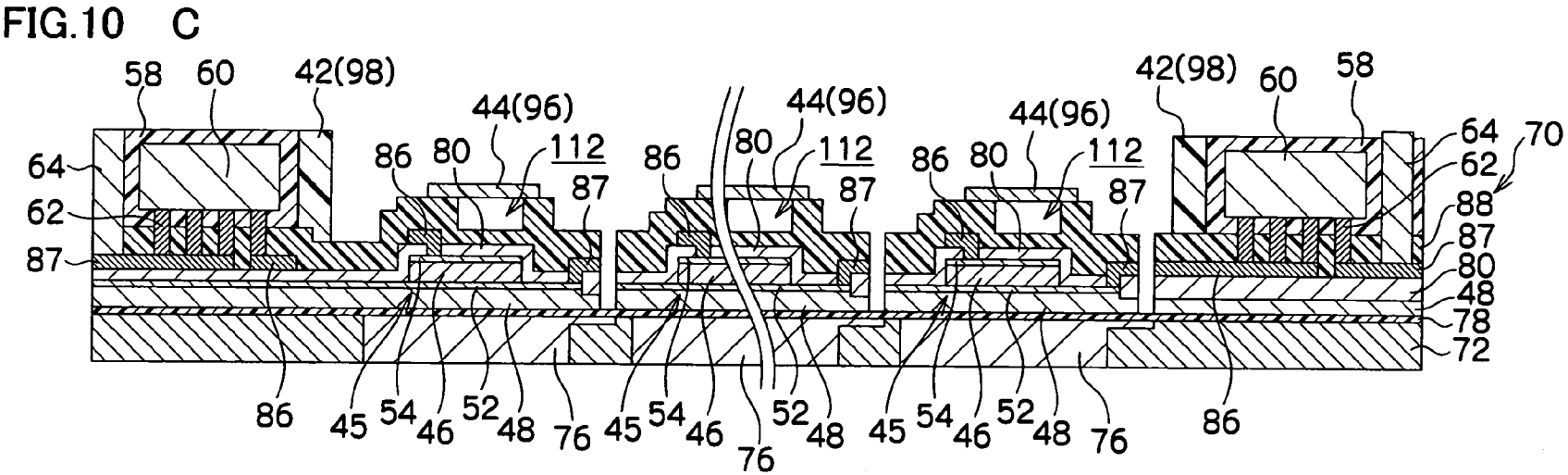

After the partitioning wall 42 and the bumps 64 are formed, as shown in FIG. 10C, the resin material 58 for sealing (e.g., an epoxy resin) is injected-in around the driving ICs 60.

Figure 10D:
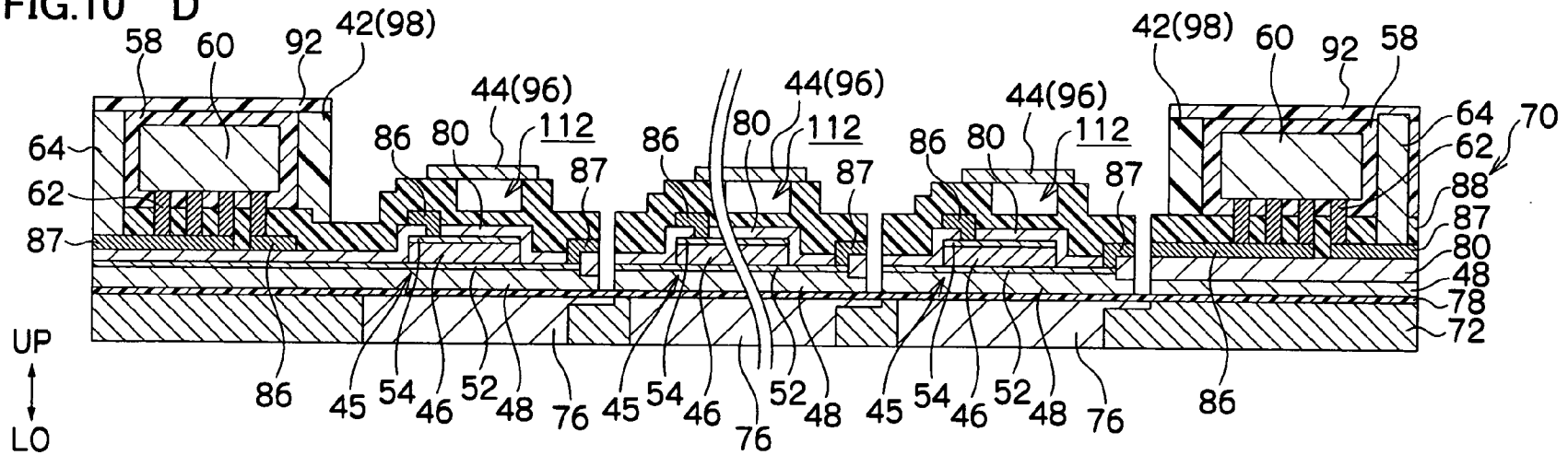
Figure 10E:
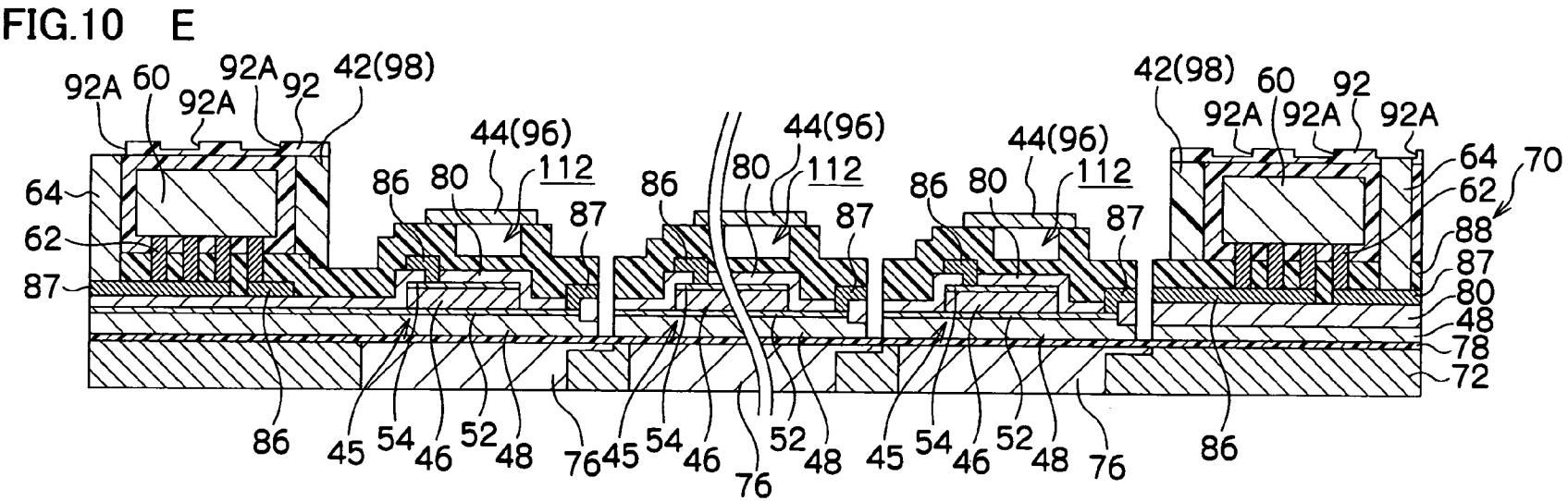
Figure 10F:
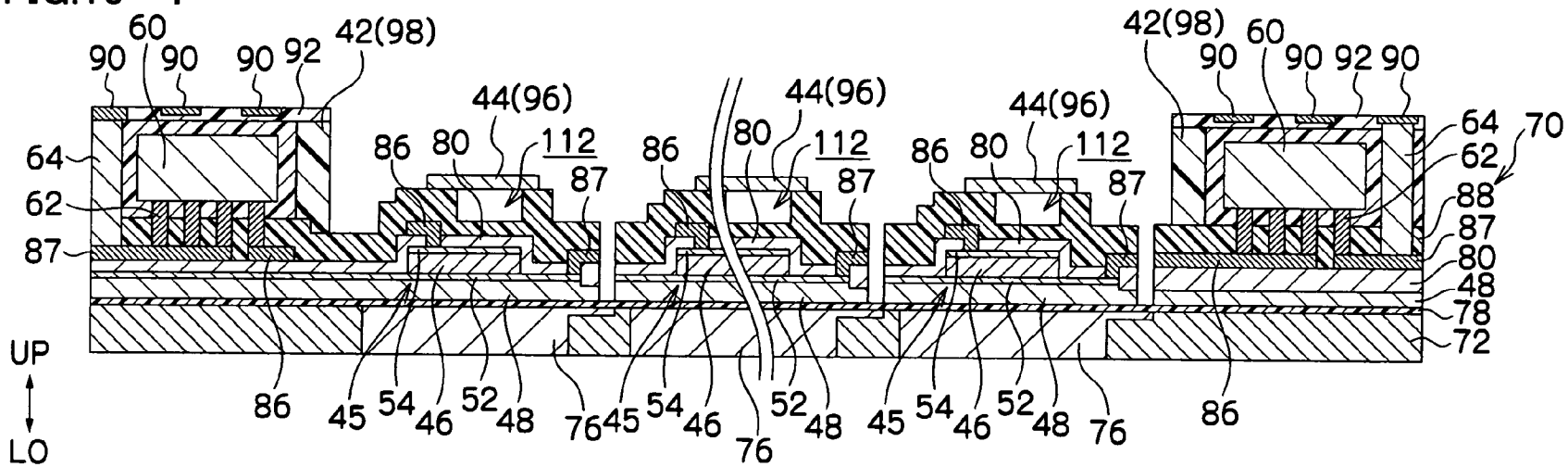

Next, as shown in FIG. 10D, the resin film 92 (e.g., photosensitive polyimide Durimide 7320 manufactured by FUJIFILM Electronic Materials Co., Ltd.) is layered on the partitioning wall 42, the bumps 64, and the resin material 58 for sealing. Then, as shown in FIG. 10E, the surface of the resin film 92 is etched such that concave portions 92A are formed, and, as shown in FIG. 10F, the metal wires 90 are layered in the concave portions 92A and are patterned. Specifically, this is deposition of an Al film (thickness: 1 μm) by sputtering, resist formation by photolithography, etching of the Al film by RIE using a chlorine gas, and removal of the resist film by oxygen plasma.

Figure 10G:
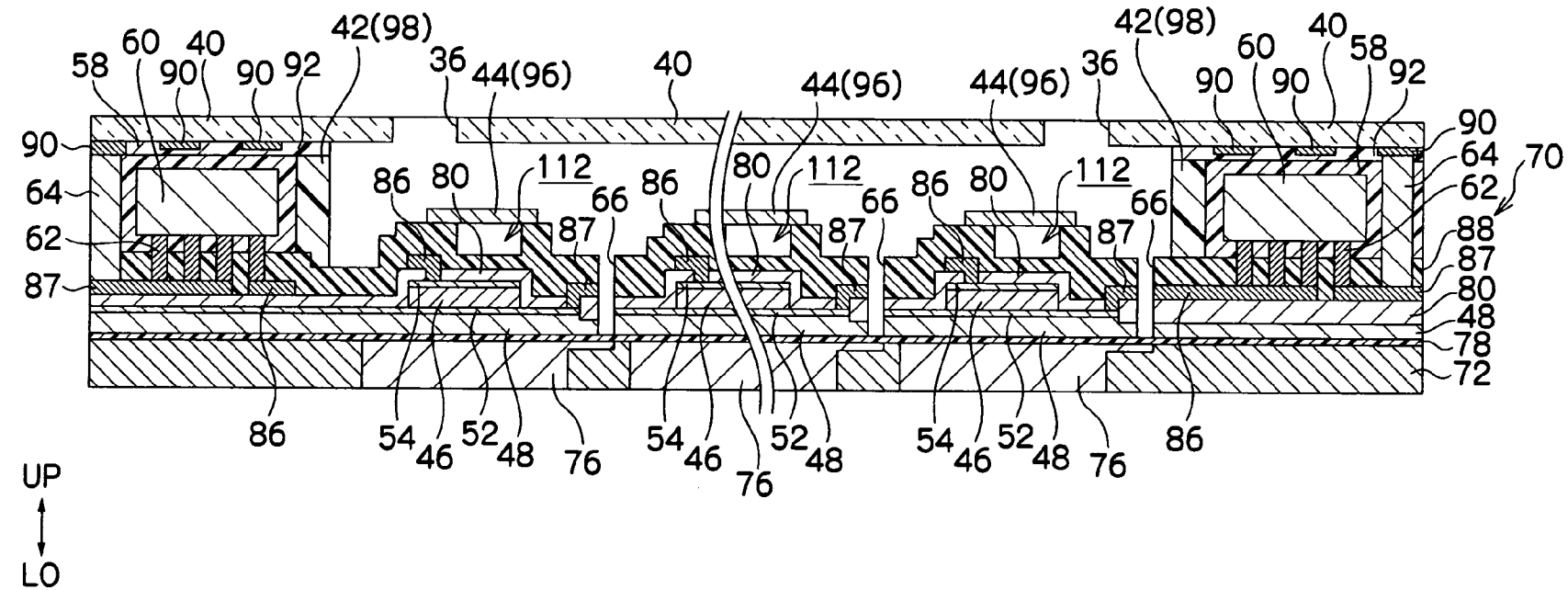

Next, as shown in FIG. 10G, the ceiling plate 40, whose support member is a glass plate, is joined (united) to the resin film 92 and the metal wires 90 by thermocompression bonding (e.g., 20 minutes at 350° C. and 2 kg/cm$^2$). Note that the ink supply ports 36, which are connected to the ink tank (not shown), are formed in advance in the ceiling plate 40 at predetermined places. Specifically, a resist of a photosensitive dry film is formed (exposed and developed) by photolithography, sandblasting processing is carried out by using this resist as a mask such that openings are formed, and thereafter, the resist is removed by oxygen plasma.

Figure 11A:
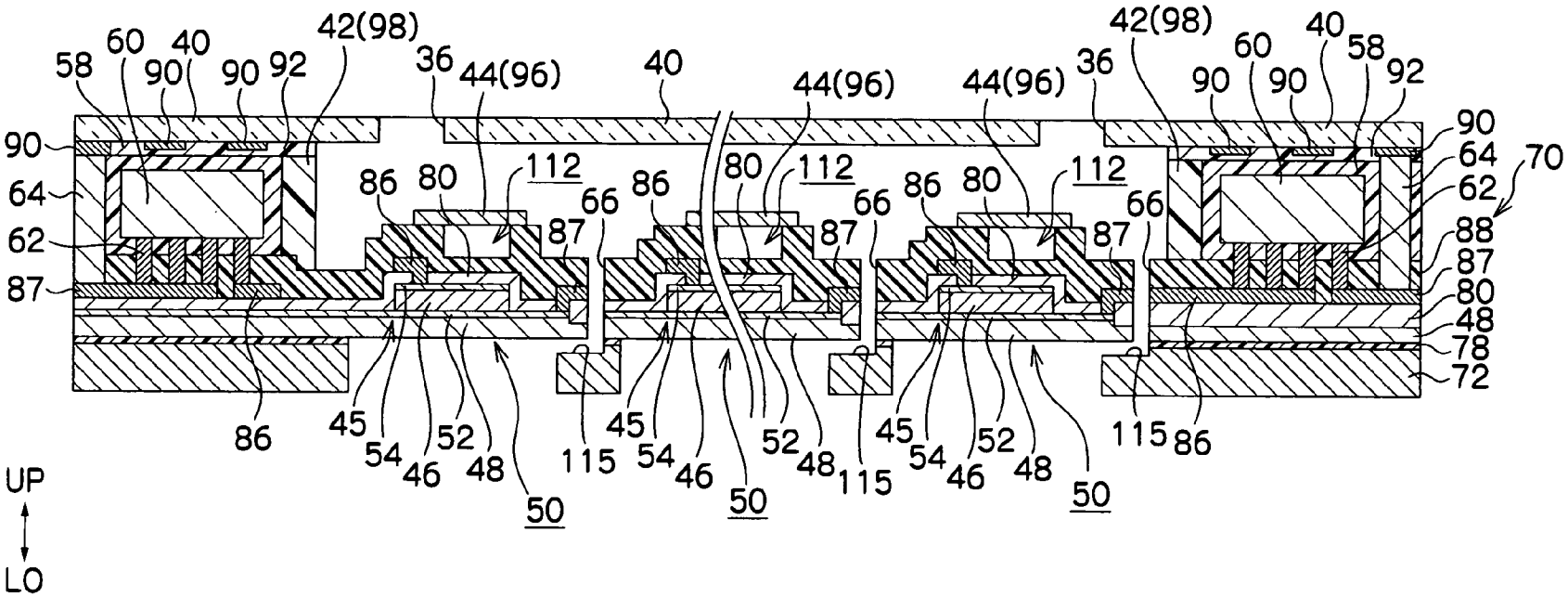
FIG. 11A is an explanatory drawing showing a process of forming pressure chambers at the silicon substrate of the inkjet recording head relating to the exemplary embodiments of the present invention.

Then, as shown in FIG. 11A, the glass paste 76 which is filled (buried) in the silicon substrate 72 is selectively removed by etching by a dissolving solution containing HF. Because the vibrating plates 48 are protected from the HF solution by the Ge film 78 at this time, the vibrating plates 48 are not etched. Namely, as described above, the Ge film 78 functions as an etching stopper layer which, at the time when the glass paste 76 is removed by etching by the HF solution, prevents the vibrating plates 48 from being removed by etching together therewith.

Note that, although a liquid containing HF is used in the removal of the glass paste 76 here, a gas or vapor containing HF may be used in the removal of the glass paste 76.

A dissolving solution for the Ge film 78, e.g., hydrogen peroxide ($H_2O_2$) which is heated to 60° C. for example, is supplied from the pressure chamber 50 side, and portions of the Ge film 78 are removed by etching. At this stage, the pressure chambers 50 and the communication paths 115 are completed. When the Ge film 78 is removed by etching in this way, at regions other than where the pressure chambers 50 and the communication paths 115 are formed, there is no particular problem in leaving the Ge film 78 as is.

Figure 11B:
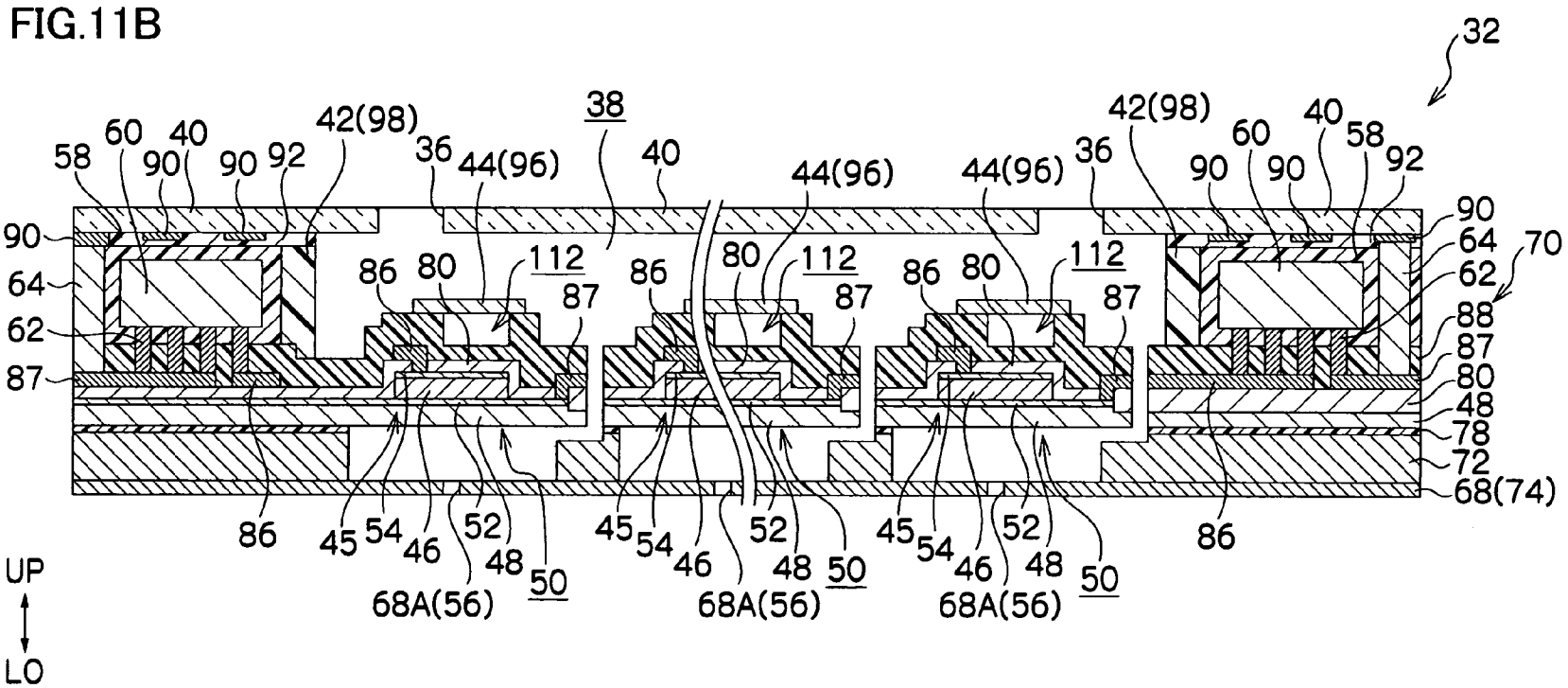
FIG. 11B is an explanatory drawing showing a process of joining a nozzle plate to the silicon substrate of the inkjet recording head relating to the exemplary embodiments of the present invention.

Then, as shown in FIG. 11B, the nozzle plate 74 is affixed to the bottom surface of the silicon substrate 72. Namely, the nozzle film 68, in which are formed openings 68A which become the nozzles 56, is affixed to the bottom surface of the silicon substrate 72.

In this way, the inkjet recording head 32 is completed, and, as shown in FIG. 5, the ink 110 can be filled into the ink pooling chamber 38 and the pressure chambers 50. Note that this manufacturing method is an example, and, when possible, the order of the respective processes may be reversed.

For example, in the present exemplary embodiment, after the ceiling plate 40 is joined (united) to the resin film 92 and the metal wires 90 in FIG. 10G, the glass paste 76 of the silicon substrate 72 is removed in FIG. 11A. However, the glass paste 76 may be removed before the joining of the ceiling plate 40.

Further, in the present exemplary embodiment, the silicon substrate 72 is opened by RIE, the glass paste 76 is filled-in, and thereafter, the steps thereafter are carried out. However, manufacturing is also possible by a method in which function portions at the peripheries of the piezoelectric elements 45 are first formed, and thereafter, the silicon substrate 72 is opened from the reverse surface and the pressure chambers 50 are formed.

Operation of the inkjet recording device 10, which is equipped with the inkjet recording head 32 which is manufactured as described above, will be described next.

First, when an electric signal instructing printing is sent to the inkjet recording device 10, one of the recording sheets P is picked-up from the stocker 24, and is conveyed by the conveying device 26.

On the other hand, at the inkjet recording unit 30, the ink 110 has already been injected-in (filled-in) in the ink pooling chamber 38 of the inkjet recording head 32 shown in FIG. 5 from the ink tank and via the ink supply ports. The ink 110 which is filled in the ink pooling chamber 38 is supplied to (filled into) the pressure chambers 50 via ink flow paths 66. At this time, a meniscus, in which the surface of the ink 110 is slightly concave toward the pressure chamber 50 side, is formed at the distal end (the ejecting opening) of the nozzle 56.

Then, while the recording sheet P is being conveyed, by ink droplets being selectively ejected from the plural nozzles 56, a portion of the image based on the image data is recorded on the recording sheet P. Namely, voltages are applied to predetermined piezoelectric elements 45 at predetermined times by the driving ICs 60, the vibrating plates 48 are flexurally deformed in the vertical direction (are vibrated with out-of-plane), pressure is applied to the ink 110 within the pressure chambers 50, and the ink 110 is ejected as ink droplets from predetermined nozzles 56. When the image based on the image data has been completely recorded on the recording sheet P in this way, the recording sheet P is discharged-out to the tray 25 by the sheet discharging belt 23. In this way, the printing processing (image recording) onto the recording sheet P is completed.

As a dry etching condition of the electrode films (high melting point metals) such as the upper electrodes 54 or the lower electrodes 52 or the like, the etching selection ratio thereof with the $SiO_2$ film of the vibrating plate 48 is small (<0.1 to 0.3). Therefore, for example, even in cases of etching an electrode film of 300 nm, an $SiO_2$ film of 1 μm is cut-in (removed) with over-etching of 30%.

Namely, due to this cutting-in by the etching, a thickness difference of 1 μm arises at the vibrating plate 48 between the region thereof beneath the lower electrode 52 and the other regions thereof. Further, due to the wafer in-plane dispersion of the etching characteristic, dispersion in the cutting-in of the vibrating plate 48 in the plane of the wafer arises, therefore, dispersion of greater than or equal to 1 μm arises in the thickness of the vibrating plate 48. Here, there are limits to optimizing the etching condition (i.e., to improving the selection ratio), accordingly it is extremely difficult to completely eliminate cutting-in of the $SiO_2$ film of the vibrating plate 48.

Figure 12A:
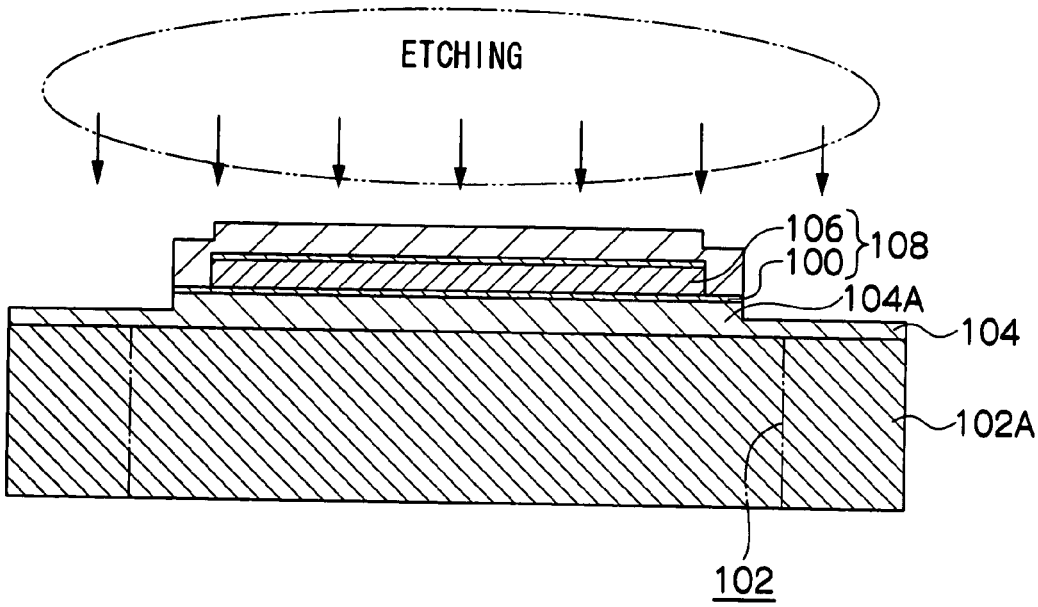
FIG. 12A is a cross-sectional view at the time of etching a lower electrode and a vibrating plate.
Figure 12B:
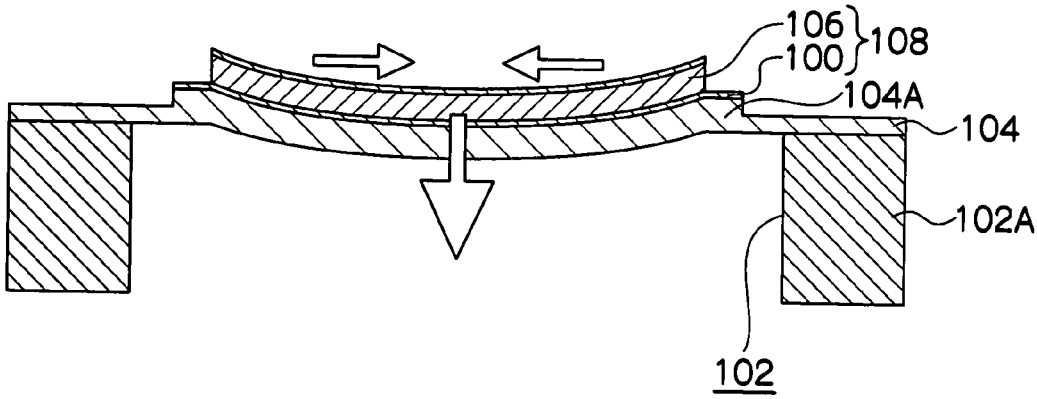
FIG. 12B is a cross-sectional view showing a state in which a piezoelectric element is flexurally deformed.

In this way, the decrease in the rigidity of the vibrating plates 48 arises, and dispersion arises in the amount of displacement per bit of each piezoelectric body 46 due to dispersion in the rigidity of the vibrating plates 48, by the cutting-in of the $SiO_2$ film of the vibrating plates 48. However, as shown in FIGS. 12A and 12B, the influences thereof are particularly marked in cases in which the region where a lower electrode 100 is formed is further toward the inner side than a peripheral wall 102A of a pressure chamber 102.

Specifically, due to the cutting-in of a vibrating plate 104, the vibrating plate 104 becomes thin, the mechanical strength of the vibrating plate 104 decreases extremely and a piezoelectric element 108, which includes a piezoelectric body 106, breaks at the time of machining. Further, the decrease in the rigidity of the vibrating plate 104 gives rise to dispersion in the amounts of displacement of the piezoelectric elements 108, such that stable driving of the device markedly deteriorates.

Thus, in order to suppress the decrease in rigidity due to the cutting-in of the vibrating plate 104, cutting-in of the vibrating plate 104 must be suppressed at regions which are thought to affect the piezoelectric characteristic. Here, a thick-walled portion 104A of the vibrating plate 104, which is positioned beneath the lower electrode 100, is not cut-in at the time when the lower electrode 100 is etched. Therefore, cutting-in of the periphery of the piezoelectric body 106 must be suppressed in order to drive the device stably.

Figures 13A, 13B:
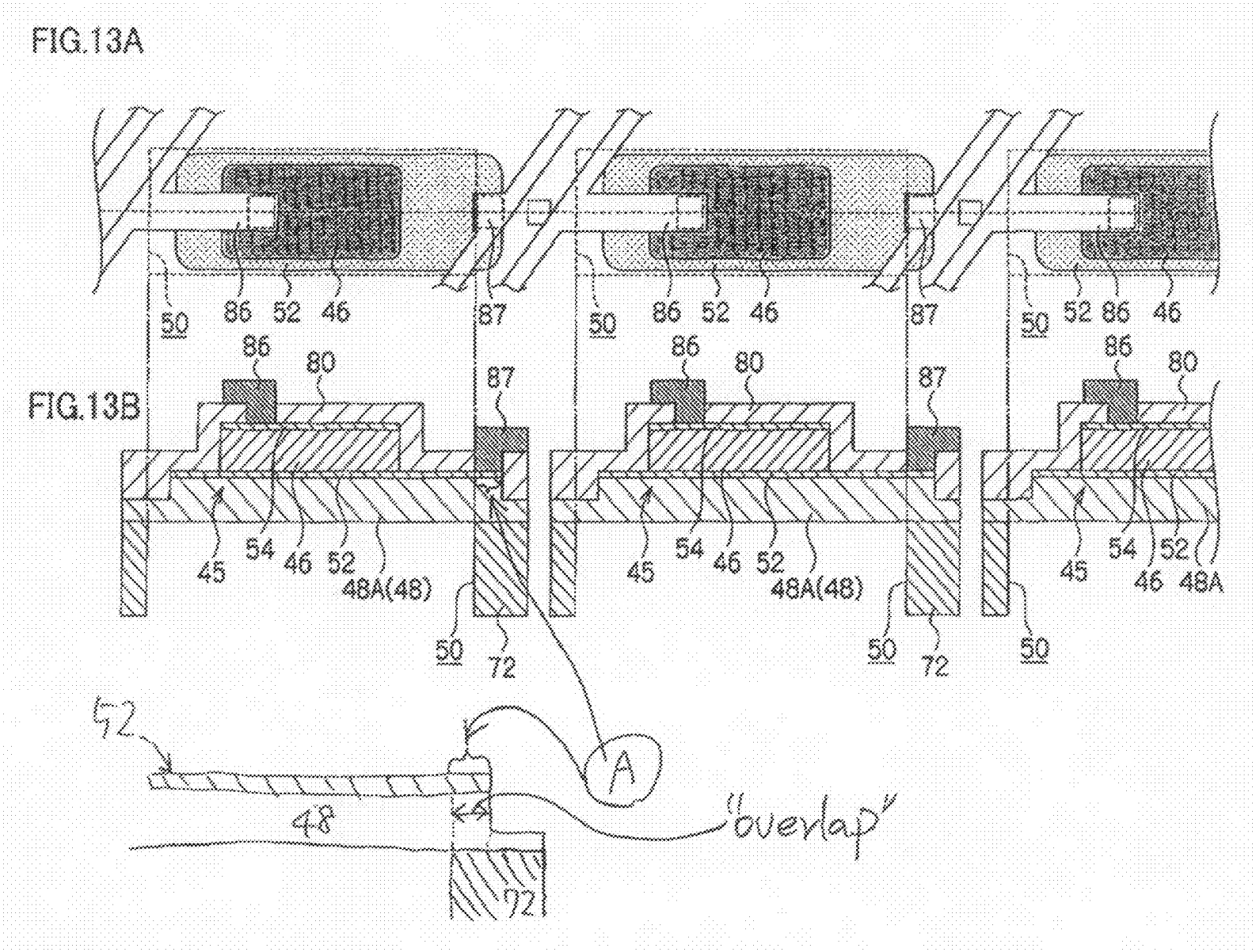
FIGS. 13A and 13B show the relationships among the piezoelectric elements, the vibrating plates, and the pressure chambers of the inkjet recording head relating to the exemplary embodiments of the present invention, where

Therefore, in the present exemplary embodiment, as shown in FIG. 13A and FIG. 13B (note that FIG. 13A is a plan view showing the relationships between the piezoelectric elements 45, the vibrating plates 48, and the pressure chambers 50, and FIG. 13B is a cross-sectional view of FIG. 13A), the piezoelectric body 46 which is substantially parallelepiped is provided further toward the inner side than the peripheral wall (the silicon substrate 72) of the pressure chamber 50, and the lower electrodes 52 are provided individually at each of the piezoelectric bodies 46, and the lower electrode 52 is of a size such that one longitudinal direction end portion of the lower electrode 52 reaches a peripheral wall of the pressure chamber 50 (the one longitudinal direction end portion of the lower electrode 52 overlaps with peripheral wall of the pressure chamber 50 when viewed from the top).

Further, the lower electrode 52 is of a size such that one end side along the longitudinal direction of the lower electrode 52 (the metal wire 87 side) reaches the peripheral wall (the silicon substrate 72) of the pressure chamber 50. Because the region which is cut-in at the time of etching is a region other than beneath the lower electrode 52, the vibrating plate 48 is of a size such that a thick-walled portion 48A of the vibrating plate 48 reaches a peripheral wall of the pressure chamber 50 (a portion of the thick-walled portion 48A of the vibrating plate 48 overlaps with the peripheral wall of the pressure chamber 50 when viewed from the top), and a decrease in the rigidity of the vibrating plate 48, which is needed for the characteristic of the piezoelectric element 45, is suppressed.

Figures 14A, 14B:
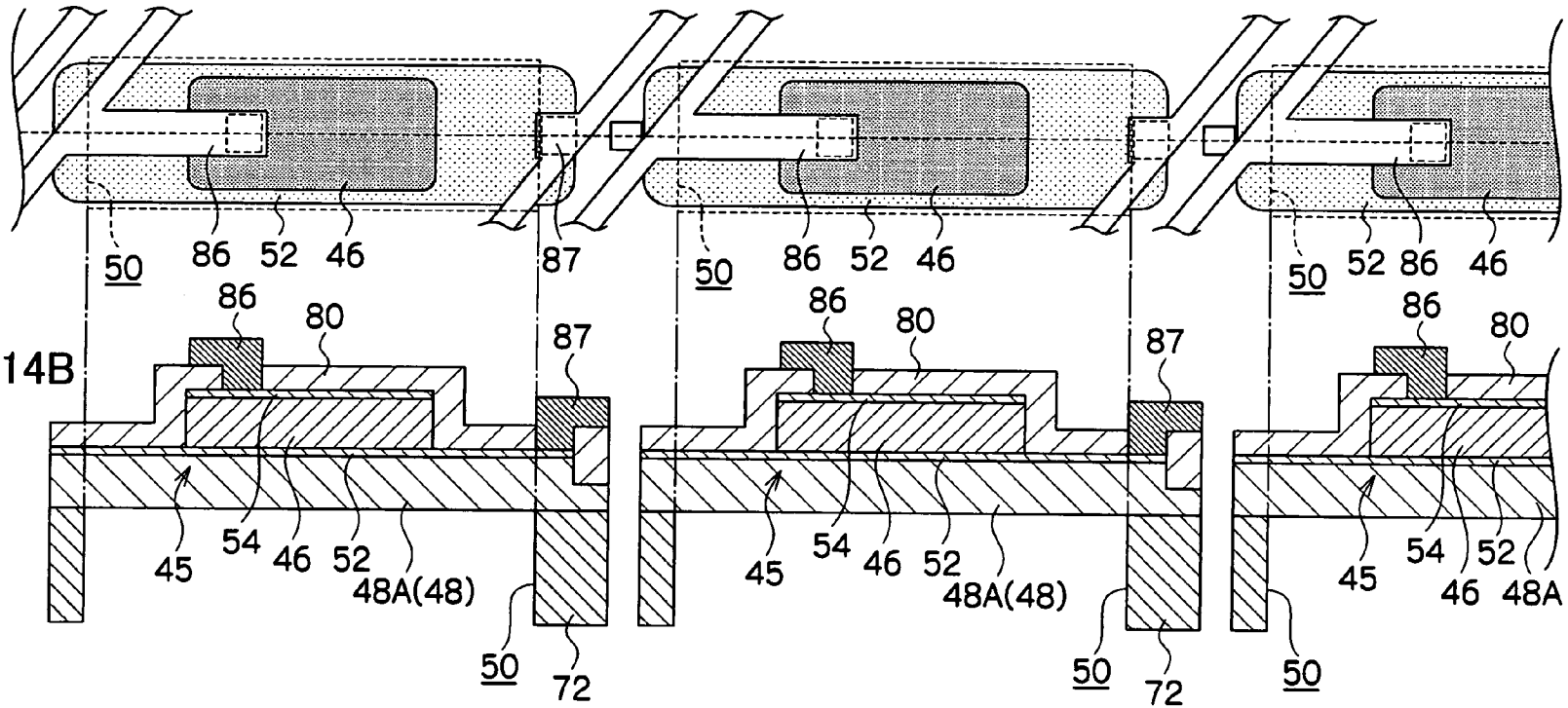
FIGS. 14A and 14B are a modified example showing the relationships among the piezoelectric elements, the vibrating plates, and the pressure chambers of the inkjet recording head relating to the exemplary embodiments of the present invention, where

Note that the present exemplary embodiment is merely an example, the present invention is not limited in any way by these structures. For example, in the present exemplary embodiment, the lower electrode 52 is of a size such that one end portion of the lower electrode 52 along the longitudinal direction reaches the peripheral wall (the silicon substrate 72) of the pressure chamber 50. However, as shown in FIG. 14A and FIG. 14B (note that FIG. 14A is a plan view showing the relationships between the piezoelectric elements 45, the vibrating plates 48, and the pressure chambers 50, and FIG. 14B is a cross-sectional view of FIG. 14A), the lower electrode 52 may be of a size such that both end portions of the lower electrode 52 along the longitudinal direction reach peripheral wall (the silicon substrate 72) of the pressure chamber 50 (the both end portions of the lower electrode 52 along the longitudinal direction overlap with the peripheral wall) in plan view (top view).

Namely, a pair of wall portions, which faces each other, of the peripheral wall of the pressure chamber 50 are bridged by the thick-walled portion 48A of the vibrating plate 48. Therefore, the lower electrode 52 and the vibrating plate 48 are reliably held by peripheral wall of the pressure chamber 50.

Figures 15A, 15B:
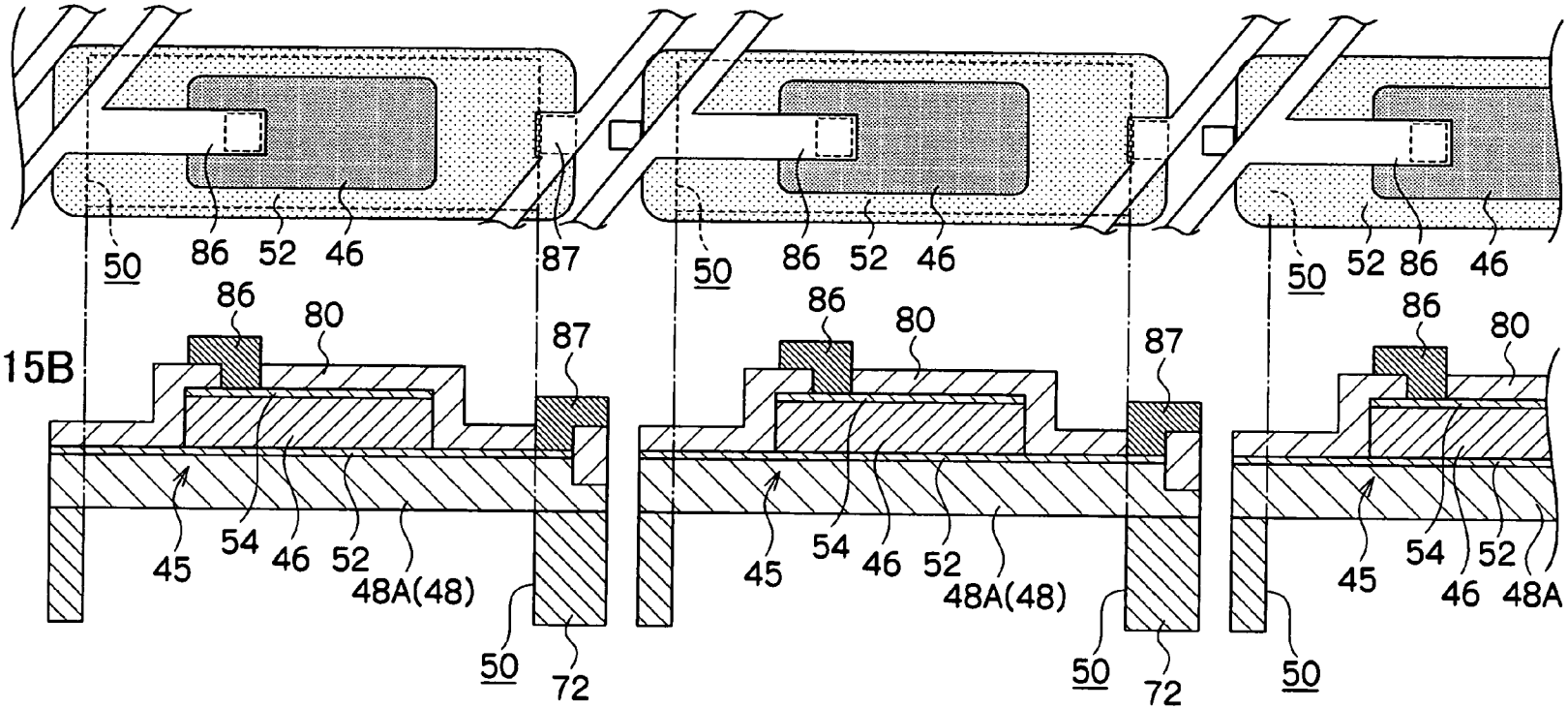
FIGS. 15A and 15B are a modified example showing the relationships among the piezoelectric elements, the vibrating plates, and the pressure chambers of the inkjet recording head relating to the exemplary embodiments of the present invention, where

Further, as shown in FIG. 15A and FIG. 15B (note that FIG. 15A is a plan view showing the relationships between the piezoelectric elements 45, the vibrating plates 48, and the pressure chambers 50, and FIG. 15B is a cross-sectional view of FIG. 15A), the lower electrode 52 may be a size such that the entire outer edge portion of the lower electrode 52 reaches the peripheral wall (the silicon substrate 72) of the pressure chamber 50 (the entire outer edge portion of the lower electrode 52 overlaps with the peripheral wall) in plan view (top view). Namely, the entire portion of the peripheral wall of the pressure chamber 50 is bridged by the thick-walled portion 48A of the vibrating plate 48. Therefore, the lower electrode 52 and the vibrating plate 48 are more reliably held by the peripheral wall of the pressure chamber 50.

On the other hand, in the present exemplary embodiment, when the piezoelectric element 45 is formed on the vibrating plate 48, as shown in FIGS. 9G and 9H, the layered film (the lower electrode layer) 63 of Ir and Ti is film-formed on the top surface of the vibrating plate 48 by sputtering, and thereafter, the PZT film (the piezoelectric body layer) 65 and the Ir film (the upper electrode layer) 67 are layered (film-formed) by sputtering in that order on the top surface of the layered film 63. It can be understood that the polarization direction of the piezoelectric body 46 due thereto is directed from the lower electrode 52 toward the upper electrode 54.

Figure 16:
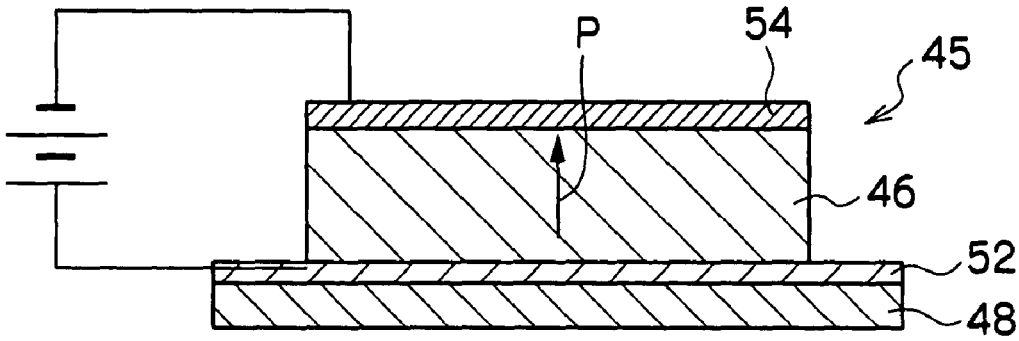
FIG. 16 is an explanatory drawing showing a wiring diagram of an upper electrode and the lower electrode of the piezoelectric element of the inkjet recording head relating to the exemplary embodiments of the present invention.

Therefore, in the present exemplary embodiment, as shown in FIG. 16, the upper electrode 54 is made to be ground potential (GND), and the lower electrode 52 and the driving IC 60 (see FIG. 4) are connected, and positive voltage is applied to the lower electrode 52.

Further, in the inkjet recording head 32, the ink pooling chamber 38 is provided at the opposite side (the upper side) of the pressure chambers 50, with the vibrating plates 48 (the piezoelectric elements 45) therebetween. In other words, the vibrating plates 48 (the piezoelectric elements 45) are disposed between the ink pooling chamber 38 and the pressure chambers 50, and the ink pooling chamber 38 and the pressure chambers 50 do not exist in the same horizontal plane.

Moreover, by providing isolating chambers 112 within the ink pooling chamber 38 and isolating the piezoelectric elements 45 from the ink 110 by the isolating chambers 112, constraining force due to the ink 110 is not applied to the piezoelectric elements 45.

On the other hand, when the pressure chamber 50 is pressurized due to the flexural deformation of the piezoelectric element 45 and the ink 110 is ejected as an ink droplet from the nozzle 56 connected to the pressure chamber 50, the pressure wave of the ink 110, which is transferred to the interior of the ink pooling chamber 38 via the ink flow path 66, is mitigated by the air damper 44 which is provided at the isolating chamber 112.

In the inkjet recording device 10 of the above-described exemplary embodiments, ink droplets are selectively ejected, on the basis of image data, from the inkjet recording units 30 of the respective colors of black, yellow, magenta, and cyan, such that a full-color image is recorded on the recording sheet P. However, the inkjet recording in the present invention is not limited to the recording of characters and images onto the recording sheet P.

Namely, the recording medium is not limited to paper, and the liquid which is ejected is not limited to ink. For example, the inkjet recording head 32 relating to the present invention can be applied to liquid droplet jetting devices in general which are used industrially, such as in fabricating color filters for displays by ejecting ink onto a high polymer film or glass, or in forming bumps for parts mounting by ejecting solder in a welded state onto a substrate, or the like.

Further, in the inkjet recording device 10 of the above-described exemplary embodiments, the example of a so-called Full Width Array (FWA), corresponding to the width of a sheet, is described. However, the present invention is not limited to the same, and may be a Partial Width Array (PWA) including a main scanning mechanism and a subscanning mechanism.

What is claimed is:

1. A liquid droplet ejecting head comprising:

a nozzle that ejects a liquid droplet;

a pressure chamber that is connected to the nozzle;

a vibrating plate that forms one portion of the pressure chamber;

a lower electrode that is formed on a surface of the vibrating plate, and exhibits one polarity;

a piezoelectric body that is flexurally-deformable, formed on a surface of the lower electrode, and disposed at a position facing the pressure chamber with the vibrating plate therebetween; and an upper electrode that is formed at a surface of the piezoelectric body opposite the surface at which the lower electrode is formed, the upper electrode exhibiting another polarity, when viewed from a direction perpendicular to the surface of the lower electrode, the piezoelectric body being provided further toward an inner side than a peripheral wall of the pressure chamber, and the lower electrode being of a size such that one portion thereof overlaps with the peripheral wall of the pressure chamber, and being individuated per each piezoelectric body.

2. The liquid droplet ejecting head of claim 1, wherein, when viewed from the direction perpendicular to the surface of the lower electrode, an entire outer edge portion of the lower electrode overlaps with the peripheral wall of the pressure chamber.

3. The liquid droplet ejecting head of claim 1, wherein a material structuring the lower electrode is one of Ir, Ru, Pt, Ta, or oxides thereof, and a material structuring the vibrating plate is one of $SiO_2$, Si or SiN.

4. The liquid droplet ejecting head of claim 1, wherein, when viewed from the direction perpendicular to the surface of the lower electrode, opposite end portions of the lower electrode in a longitudinal direction thereof overlap with the peripheral wall of the pressure chamber.

5. The liquid droplet ejecting head of claim 1, wherein, when viewed from the direction perpendicular to the surface of the lower electrode, one end portion of the lower electrode in a longitudinal direction thereof overlaps with the peripheral wall of the pressure chamber.

6. The liquid droplet ejecting head of claim 1, wherein the piezoelectric body is formed by using a sputtering method.

7. The liquid droplet ejecting head of claim 1, wherein, when viewed from the direction perpendicular to the surface of the lower electrode, one portion of the vibrating plate which is beneath the one portion of the lower electrode overlapping with the peripheral wall of the pressure chamber, overlaps with the peripheral wall of the pressure chamber.

8. An image forming device comprising:

a liquid droplet ejecting head including a nozzle that ejects a liquid droplet, a pressure chamber that is connected to the nozzle, a vibrating plate that forms one portion of the pressure chamber, a lower electrode that is formed on a surface of the vibrating plate, and exhibits one polarity, a piezoelectric body that is flexurally-deformable, formed on a surface of the lower electrode, and disposed at a position facing the pressure chamber with the vibrating plate therebetween, and an upper electrode that is formed at a surface of the piezoelectric body opposite the surface at which the lower electrode is formed, the upper electrode exhibiting another polarity, when viewed from a direction perpendicular to the surface of the lower electrode, the piezoelectric body being provided further toward an inner side than a peripheral wall of the pressure chamber, and the lower electrode being of a size such that one portion thereof overlaps with the peripheral wall of the pressure chamber, and being individuated per each piezoelectric body;

a recording section including a recording head portion that ejects the liquid droplet from the liquid droplet ejecting head to form an image;

a supplying section that feeds a recording medium to the recording section; and a discharging section that discharges the recording medium on which an image has been formed.

9. The image forming device of claim 8, wherein, when viewed from the direction perpendicular to the surface of the lower electrode, one portion of the vibrating plate which is beneath the one portion of the lower electrode overlapping with the peripheral wall of the pressure chamber, overlaps with the peripheral wall of the pressure chamber.

10. A method of manufacturing a liquid droplet ejecting head comprising:

forming a pressure chamber layer that becomes a pressure chamber connected to a nozzle that ejects a liquid droplet;

forming, on a surface of the formed pressure chamber layer, a vibrating plate layer that becomes a vibrating plate forming one portion of the pressure chamber;

forming, on a surface of the formed vibrating plate, a lower electrode layer that becomes a lower electrode exhibiting one polarity of a piezoelectric element that displaces the vibrating plate;

forming, on a surface of the formed lower electrode layer, a piezoelectric body layer that becomes a piezoelectric body of the piezoelectric element which is flexurally-deformable;

forming, on a surface of the formed piezoelectric body layer, an upper electrode layer that becomes an upper electrode exhibiting another polarity of the piezoelectric element;

after forming the upper electrode layer, patterning the upper electrode layer and the piezoelectric body layer such that the piezoelectric body is located at an inner side of a peripheral wall of the pressure chamber when viewed from a direction perpendicular to the lower electrode layer; and after patterning the upper electrode layer and the piezoelectric body layer, patterning the lower electrode layer such that the lower electrode becomes a size such that one portion thereof overlaps with the peripheral wall of the pressure chamber, and the lower electrode is individuated per each piezoelectric body, when viewed from the direction perpendicular to the lower electrode layer.

11. The method of claim 10, wherein, when viewed from the direction perpendicular to the lower electrode layer, an entire outer edge portion of the lower electrode overlaps with the peripheral wall of the pressure chamber.

12. The method of claim 10, wherein a material structuring the lower electrode layer is one of Ir, Ru, Pt, Ta, or oxides thereof, and a material structuring the vibrating plate is one of $SiO_2$, Si or SiN.

13. The method of claim 10, wherein, when viewed from the direction perpendicular to the lower electrode layer, opposite end portions of the lower electrode in a longitudinal direction thereof overlap with the peripheral wall of the pressure chamber.

14. The method of claim 10, wherein, when viewed from the direction perpendicular to the lower electrode layer, one end portion of the lower electrode in a longitudinal direction thereof overlaps with the peripheral wall of the pressure chamber.

15. The method of claim 10, wherein the piezoelectric body layer is formed by using a sputtering method.

16. The method of claim 10, wherein, when viewed from the direction perpendicular to the surface of the lower electrode, one portion of the vibrating plate which is beneath the one portion of the lower electrode overlapping with the peripheral wall of the pressure chamber, overlaps with the peripheral wall of the pressure chamber.

* * * * *